US008545290B2

(12) United States Patent
Abrahamians et al.

(10) Patent No.: US 8,545,290 B2
(45) Date of Patent: Oct. 1, 2013

(54) WAFER POLISHING APPARATUS AND METHOD

(75) Inventors: Edmond Arzumau Abrahamians, Fremont, CA (US); Vladimir Volovich, Mountain View, CA (US)

(73) Assignee: Edmond Arzuman Abrahamians, Fremont, CA (US)

( * ) Notice: Subject to any disclaimer, the term of this patent is extended or adjusted under 35 U.S.C. 154(b) by 428 days.

(21) Appl. No.: 12/963,459

(22) Filed: Dec. 8, 2010

(65) Prior Publication Data

US 2012/0149286 A1 Jun. 14, 2012

(51) Int. Cl.
*B24B 1/00* (2006.01)

(52) U.S. Cl.
USPC ..... 451/10; 451/5; 451/41; 451/59; 451/287; 451/290

(58) Field of Classification Search
USPC ..... 451/5, 285–287, 10, 11, 41, 398, 451/8, 9, 59, 290
See application file for complete search history.

(56) References Cited

U.S. PATENT DOCUMENTS 5,549,502 A * 8/1996 Tanaka et al. ..... 451/8
5,562,530 A * 10/1996 Runnels et al. ..... 451/36
6,402,590 B1 * 6/2002 Neston et al. ..... 451/9
6,494,775 B1 * 12/2002 Abrahamians et al. ..... 451/398
6,511,368 B1 * 1/2003 Halley ..... 451/287
6,514,129 B1 * 2/2003 Halley ..... 451/291
6,517,420 B2 * 2/2003 Ishikawa et al. ..... 451/67
6,716,093 B2 * 4/2004 Engdahl et al. ..... 451/287
6,808,443 B2 * 10/2004 Halley ..... 451/287
6,855,030 B2 * 2/2005 Halley ..... 451/5
6,869,337 B2 * 3/2005 Boyd et al. ..... 451/41
6,872,129 B2 * 3/2005 Tobin ..... 451/287
7,081,038 B2 * 7/2006 Ina ..... 451/5
7,112,889 B1 * 9/2006 Maruyama et al. ..... 257/797
7,137,874 B1 * 11/2006 Bovio et al. ..... 451/41
2003/0139122 A1 * 7/2003 Lawing ..... 451/288
2004/0048550 A1 * 3/2004 Halley ..... 451/5

* cited by examiner

*Primary Examiner* — George Nguyen
(74) *Attorney, Agent, or Firm* — GSS Law Group

(57) ABSTRACT

A wafer polishing apparatus includes a rotatable turntable for holding a polishing pad and at least one rotatable polishing head adapted for attachment of at least one wafer alignment assembly. A wafer alignment assembly includes an upper plate and a lower plate connected by three lever assemblies symmetrically positioned about a wafer alignment assembly axis of rotation. Each of the lever assemblies comprises a spherical joint, an elongated cylindrical hinge, and a kinematic axis which intersects a center of rotation for the spherical hinge, an axis of rotation for the elongated cylindrical hinge, and a gimbal point about which a wafer may tilt during polishing. The gimbal point may be positioned above, coincident with, or below a working surface of a polishing pad by adjustment of the lever assemblies. Some embodiments of the invention comprise steps in a method for polishing a wafer in a wafer polishing apparatus.

27 Claims, 11 Drawing Sheets

Section A-A

Section B-B
204
(304)
202, 302A
203
209
210
306 (208)
212
214
450
336
320A
332
216
206
420
311A
420
334
322A
308A
308B
326
338
340
341A
342B
341
342A

WAFER POLISHING APPARATUS AND METHOD

FIELD OF THE INVENTION

Embodiments of the invention are related generally to polishing machines for polishing thin, flat work pieces and more specifically for apparatuses for polishing wafers used in semiconductor, optical, solar and other industries.

BACKGROUND

Wafer polishing machines generally include a turntable that may be driven in rotation about a vertical axis passing through the center of the turntable. A replaceable polishing pad may be mounted on an upper surface of the turntable. A wafer to be polished is held by a wafer carrier attached to a rotatable polishing head. Some wafer polishing machines include more than one polishing head and some polishing machines for polishing wafers in batches have polishing heads that are adapted for attachment of more than one wafer carrier. Wafer polishing may be performed by lowering a polishing head until a surface to be polished on each wafer contacts an upper surface of the rotating polishing pad. Polishing slurry, which may include chemical polishing agents and abrasive particles, may be applied to the polishing pad.

To achieve a high quality of wafer polishing, where high quality polishing generally refers to forming a uniformly flat, smooth surface on a wafer, a wafer to be polished may be pressed into the polishing pad with a large normal force. In some previously known wafer polishing machines, a lower part of a polishing head may be connected to an upper part with a spherical joint as in, for example, U.S. Pat. No. 4,194,324 to Bonora et al. The spherical joint, sometimes referred to as a ball-and-socket joint, includes a shaft ending in a spherical socket which fits securely over a convex spherical surface of a lower part of the polishing head. The ball-and-socket joint enables a wafer carrier attached to the polishing head to tilt around relative to the common center of the spherical surface. A wafer attached to the wafer carrier is therefore able to maintain contact with the polishing pad across the entire lower surface of the wafer.

The coefficient of friction between the polishing pad and the wafer being polished may be large. The coefficient of friction and the normal force pressing the wafer into the polishing pad may result in a large frictional force directed horizontally, that is, approximately parallel to the working surface of the polishing pad. For previously known wafer polishing machines having a spherical joint in a polishing head, there may be a vertical separation distance between the rotational center of the spherical joint and the working surface of the polishing pad. The large frictional force and the vertical separation distance between the center of rotation of the spherical joint and the surface of the polishing pad may result in a large torque force in a vertical plane being applied to a wafer carrier. The torque force may result in undesirable deviations from flatness of a wafer's polished surface. For example, the torque force may increase pressure between a wafer and polishing pad along the leading edge of the wafer and decrease pressure along the trailing edge of the wafer as the wafer and wafer carrier move across the polishing pad by rotational motions of the polishing head and turntable. The difference in pressure between a wafer's leading and trailing edges may result in a polished surface which is not sufficiently flat, corresponding to a reduction in polishing quality. The pressure difference may also reduce the service lifetime of the polishing pad.

A wafer polishing machine having more than one wafer on each wafer carrier may be able to perform batch processing, that is, simultaneous polishing of a batch comprising more than one wafer. For previously known wafer polishing machines, material may be removed more quickly from a thicker wafer than from other, thinner wafers attached to the same wafer carrier. Differences in rates of material removal from wafer to wafer may result in undesirable differences in polishing quality between wafers. It is therefore known to sort wafers into batches with each batch having a specified range of wafer thickness. The range of wafer thickness for each batch may be related to variations in wafer flatness within each batch. Even with wafer sorting, some undesirable variation in polishing quality, such as variations in wafer flatness, may still occur from wafer to wafer. Wafer thickness sorting may therefore lead to a compromise in the quality of polished wafers. Furthermore, labor costs for wafer sorting and costs for purchasing, installing, operating, and maintaining wafer thickness measurement equipment add to the cost of polished wafers.

For some previously known wafer polishing machines with more than one wafer per carrier, each wafer cannot freely rotate around its own axis. Parts of a wafer that are closer to the rotational center of a polishing head may therefore be polished at a different rate than parts of the wafer that are farther from the rotational center. Differences in contact pressure between the wafers on different wafer carriers and the polishing pad and variations in slurry distribution from one wafer to another may also cause variations in the quality of polished wafers.

Efforts have been made to reduce the vertical separation distance between the rotational center of the spherical joint and the surface of the polishing pad. See for example U.S. Pat. No. 5,377,451 to Leoni et al. and U.S. Pat. No. 7,137,874 to Bovio et al. A previously known method for reducing the vertical separation distance is to increase the radii of the pivoting spherical surfaces in the spherical joint in a polishing head. Another previously known method is to replace sliding bearings with rolling bearings. Yet another previously known method is to encapsulate the outside part of a spherical bearing with a spherical surface formed into part of a wafer carrier. However, friction from the encapsulating spherical surface may increase torque on the wafer carrier, causing undesirable polishing variations across wafer surfaces.

A flexible boot may be used in some wafer polishing machines for rotationally driving a wafer carrier. However, the stiffness of the boot may also increase torque in a vertical plane on the carrier. The increase in torque from the flexible boot reduces the effectiveness of reducing the vertical separation distance between the rotational center of the spherical joint and the surface of the polishing pad. The increase in torque further causes a geometric point about which the carrier may tilt and rotate, the geometric point being referred to herein as a gimbal point, to be displaced from the geometric center of the spherical surfaces in the spherical joint. The attribute of flexibility in a boot, with high flexibility preferred for uniform polishing of all the wafers in a polishing batch, and the attribute of rigidity in the boot, with high rigidity preferred for predictable, controllable rotation of a wafer carrier are in opposition to each other for high quality polishing and may lead to conflicting requirements for polishing parameters.

For previously known wafer polishing machines, it may be difficult to predict how the gimbal point will be displaced from the rotational center of the spherical joint. It may therefore be difficult to set up a wafer polishing machine to achieve desired polishing results. Furthermore, an optimum value for the vertical separation distance between the gimbal point and the working surface of the polishing pad may depend on parameters such as radii of the pivoting spherical surfaces in the spherical joint, pressure applied to the wafers, wafer diameter, type of polishing slurry, polishing slurry flow rate, polishing pad material, rates of rotation of the polishing heads and turntable, and other factors. For a polishing machine with a fixed relationship between the separation of the gimbal point and polishing pad, optimal polishing conditions may be achieved for one selected set of operational parameters, but polishing with different parameters may result in suboptimal polishing.

SUMMARY

Some embodiments of the invention comprise a wafer polishing apparatus. The wafer polishing apparatus includes a lower frame, a base mounted on the frame, a turntable having an upper surface and a turntable axis of rotation, wherein the turntable is rotationally coupled to the base. A polishing pad may be removably attached to the upper surface of the turntable, and an upper surface of the polishing pad is a work surface for wafer polishing. The wafer polishing apparatus further includes an upper frame movably coupled to the base and at least one polishing head rotatably coupled to the upper frame. Each polishing head further comprises a polishing head axis of rotation parallel to and not coincident with the turntable axis of rotation, and each polishing head is coupled to a head drive mechanism for driving the polishing heads in rotation and vertical motion with selected downward pressure of the polishing heads.

The wafer polishing apparatus further includes at least one wafer alignment assembly attached to each polishing head. Each wafer alignment assembly comprises a wafer alignment assembly axis of rotation, an upper plate, and three lever assemblies attached symmetrically about the wafer alignment assembly axis of rotation to the upper plate. Each of the three lever assemblies comprises a spherical joint, an elongated cylindrical hinge, and a kinematic axis which passes through a center of rotation for the spherical hinge and an axis of rotation for the elongated cylindrical hinge. Each wafer alignment assembly further includes positioning means for a gimbal point located at a common point of intersection for the kinematic axes of the three lever assemblies. A vertical distance between the gimbal point and a lower surface of the polished wafer may be changed to optimize the polishing process. A wafer surface being polished is able to tilt in all directions relative to the gimbal point. Embodiments of a lever assembly include a lower plate attached to the three lever assemblies and a wafer carrier removably attached to the lower plate. A vertical position of the gimbal point may be changed so that the gimbal point is located at a selected position that is alternatively above, below or on the wafer surface to be polished for optimizing wafer polishing.

Some embodiments of the invention comprise steps in a method for polishing a wafer in a wafer polishing apparatus, including the steps of attaching a wafer to be polished to a wafer carrier, attaching the wafer carrier to a wafer alignment assembly on a polishing head of a wafer polishing apparatus, selecting according to polishing process requirements a vertical position of a gimbal point of the wafer alignment assembly on the wafer alignment assembly rotational axis relative, wherein the selected vertical position relative to the wafer-pad interface may alternatively be above, below, or coincident with the wafer-pad interface, rotating a polishing pad in a first selected direction and at a first selected rate of rotation around a polishing pad axis of rotation, and rotating the polishing head in a second selected direction at a second selected rate of rotation around a polishing head axis of rotation. The polishing head axis of rotation and the polishing pad axis of rotation may be separated by a selected distance. The method further includes the steps of lowering the polishing head until the wafer to be polished contacts a working surface of the polishing pad, establishing thereby a wafer-pad interface, adjusting an amount of contact pressure between the wafer being polished and the polishing pad, polishing the wafer to achieve a selected quality of polishing, and disengaging the wafer from the turntable; and removing the wafer from the polishing head.

The above summary is not intended to represent each disclosed embodiment, or every aspect, of the present invention. Other aspects and example embodiments are provided in the Figures and the detailed description that follow.

DESCRIPTION

Figure 1:
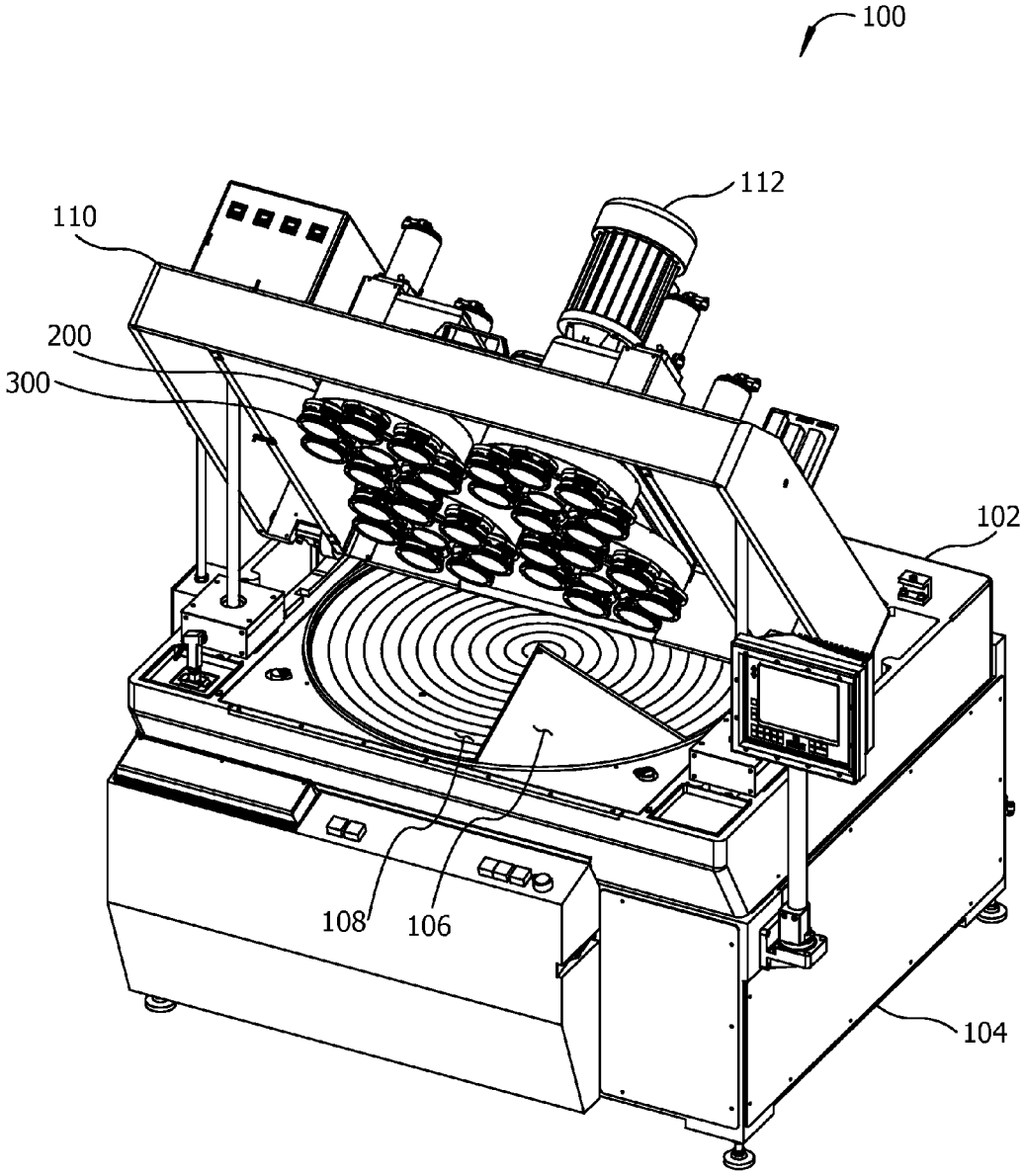
FIG. 1 illustrates a pictorial view of an example of a wafer polishing machine in accord with an embodiment of the invention.

A wafer polishing apparatus is provided for polishing thin, flat work pieces such as semiconductor, optical, solar or similar wafers. A wafer polishing apparatus in accord with an embodiment of the invention includes a wafer alignment assembly having kinematic positioning features for maintaining an accurate parallel relationship between a wafer surface to be polished and an upper surface of a polishing pad in a wafer polishing machine. The kinematic positioning features in a wafer alignment assembly enable a wafer polishing machine in accord with an embodiment of the invention to rapidly and efficiently polish wafers either singly or simultaneously in batches, where a batch refers to a group of wafers being polished on one polishing head. Each wafer in a batch to be polished by an embodiment of the invention may have a thickness that differs substantially from other wafers in the same batch.

Embodiments of the invention comprising a wafer polishing machine include a lower frame, a base mounted on the frame, a turntable rotationally coupled to the base, and a replaceable polishing pad positioned on an upper surface of the turntable. An upper surface of the polishing pad, referred to herein as the working surface of the pad, engages with a surface of a wafer during wafer polishing. The wafer surface being polished may be referred to as the front surface of the wafer. An area of contact between the working surface of the pad and the front surface of the wafer is referred to as the wafer-pad interface. One or more polishing heads are rotatably coupled to a lid hinged to the base. In a preferred embodiment, a wafer polishing machine includes four polishing heads. During polishing, each polishing head rotates about its own axis of rotation. The axis of rotation for each polishing head is displaced laterally from the turntable's axis of rotation when the lid is closed and the front surfaces of wafers being polished are in contact with the working surface of the polishing pad. An amount of downward pressure, where downward refers to a direction from the lid toward the working surface of the polishing pad, may be selected individually for each polishing head.

Embodiments of the invention comprise a wafer alignment assembly adapted for attachment to a polishing head. In a preferred embodiment, a wafer alignment assembly comprises an upper plate and a lower plate linked to each other by three lever assemblies located between the plates and spaced symmetrically around a central axis of rotation for the wafer alignment assembly. A removable wafer carrier may be attached to a bottom surface of the lower plate for holding a wafer to be polished with the front surface of the wafer facing downward during polishing. The lever assemblies enable a wafer attached to the wafer carrier to tilt relative to a gimbal point. A vertical position of the gimbal point may be selected to be in proximity on either side or on of wafer-pad interface. A selectable vertical separation distance between the gimbal point and the working surface of the polishing pad is defined by kinematic features of the lever assemblies. Each lever assembly includes a spherical joint and an elongated cylindrical hinge, with the kinematic axes of the three lever assemblies intersecting at the gimbal point for the wafer alignment assembly.

Some embodiments of the invention include a polishing head adapted to carry one wafer alignment assembly for holding one wafer to be polished. A polishing head may optionally be adapted to carry more than one wafer alignment assembly. In a preferred embodiment, a polishing head is adapted to carry at least three wafer alignment assemblies. Other embodiments of the invention include a wafer polishing machine having at least one polishing head, with each polishing head having one or more wafer alignment assemblies. A wafer polishing machine in accord with an embodiment of the invention is therefore able to simultaneously polish a plurality of wafers to a selected condition of planarization, and is particularly advantageous for polishing wafers having different thicknesses. For example, if a range of wafer thickness which may be planarized simultaneously on a previously known wafer polishing machine is represented as "$x \pm y$", a range of wafer thickness which may be planarized simultaneously on a wafer polishing machine in accord with an embodiment of the invention may be represented as "$x \pm (n \times y)$", where "x" alternatively refers to nominal thickness or average thickness and "n" has a value of at least 10. For some embodiments of the invention, "n" has a value of at least 20. Wafers may therefore be sorted into fewer groups by thickness than for previously known wafer polishing machines.

Advantages of the embodiments of a wafer polishing apparatus disclosed herein include individual selectability of a vertical position of a gimbal point of for each wafer alignment assembly, coincidence of points about which a wafer carrier and a wafer alignment assembly tilt, changing of the vertical position of the gimbal point to be either above, coincident with, or below an upper surface of a polishing pad without replacing major parts of a wafer alignment assembly, and equal polishing pressure at every point on the wafer surface being polished. Alternately, a selected magnitude of pressure difference may be intentionally applied between two separated points on the wafer surface being polished. Furthermore, a magnitude of a torque which acts to cause a rotation of a wafer being polished to rotate out of the plane of the working surface of a polishing pad may be controlled by changing a vertical location of the gimbal point of a wafer alignment assembly. Other advantages include high quality batch polishing of more than one wafer on a same polishing head without presorting wafers according to wafer thickness, rotation of each wafer around its own axis, synchronized rotation at a same rate of rotation of all wafers attached to a same polishing head, reduction of polishing differences across a wafer surface caused by variations in properties across a polishing pad, and reduction of polishing differences across wafer surfaces in a polishing batch. Another advantage is that a gimbal point for a wafer alignment assembly is coincident with an axis of rotation for a wafer attached to the wafer alignment assembly.

Compared to previously known wafer polishing machines, other advantages of the embodiments of the invention include, but are not limited to, improving the flatness and quality of polished wafers, increasing the throughput of wafer polishing, where throughput refers to a number of wafers polished in a selected time interval, increasing the service lifetime of a polishing pad used in the wafer polishing machine, improved adjustability, and therefore ability to optimize, different amounts of pressure applied to the leading and trailing portions of wafers being polished, and application of nearly equal amounts of pressure to each of the wafers in a batch, regardless of wafer thickness variations. Other advantages include an ability to synchronize rotation of all wafers attached to wafer alignment assemblies on one polishing head while rotating each wafer about a vertical axis passing through a center point of a surface being polished on each wafer, and reducing the effects of variations in polishing conditions at different locations on a polishing pad.

More advantages of the disclosed embodiments include selectable positioning of a gimbal point along a rotational axis for a wafer alignment assembly, and selectable positioning of a gimbal point to be above, coincident with, or lower than an upper surface of a polishing pad, also referred to as the working surface of the polishing pad. Additional advantages include adjustability of the gimbal point to optimize wafer polishing for different wafer diameters, different types of polishing compound, different polishing compound flow rates, and other parameters related to operation of a wafer polishing machine.

Embodiments of the invention are also advantageous for reducing undesirable planarization effects resulting from misalignment of various parts of a wafer polishing machine, for example systematic errors related to misalignment between the axes of rotation of the polishing heads, subheads, and the turntable. Additionally, a wafer polishing apparatus in accord with an embodiment of the invention may be operated at a higher rate of wafer polishing, corresponding to a higher rate of batch processing, than previously known wafer polishing machines.

Turning now to the figures, FIG. 1 illustrates an example of a wafer polishing apparatus in accord with an embodiment of the invention. The wafer polishing apparatus 100 of FIG. 1 includes a lower frame 104 and a base 102 attached to the lower frame. A lid 110, also referred to herein as an upper frame and shown in its raised position in FIG. 1, is attached by hinges (not illustrated) to the base 102 for accessing a replaceable polishing pad 108 attached to a turntable 106. In FIG. 1, the polishing pad 108 is shown with a wedge-shaped section removed to expose the top surface of the turntable 106. The upper surface of the polishing pad 108, that is, the surface visible in FIG. 1, is also referred to as the working surface of the polishing pad. The turntable 106, also referred to as a platen 106, is supported by the base 102 and is driven in rotation in a selected direction and at a selected rate of rotation by a motor (not illustrated) inside the lower frame 104.

Four polishing heads 200 are shown in FIG. 1 on the underside of the lid 110. Each polishing head 200 is supported from the lid 110 and is driven in rotation in a selected direction and at a selected rate of rotation by an upper frame drive mechanism comprising a head assembly drive motor 112. The upper frame drive mechanism further includes means for adjusting a vertical position of a polishing head and means for adjusting an amount of downward pressure by which a polishing head presses a wafer to be polished into the working surface of the polishing pad. All four polishing heads 200 may optionally be driven in a same selected direction of rotation and at a same selected rate of rotation, for example by a continuous drive belt (not illustrated) coupled to a pulley on each head. A wafer polishing apparatus 100 may optionally include a different number of polishing heads 200 than the four shown in the example of FIG. 1.

Each of the polishing heads 200 in the example of FIG. 1 includes seven wafer alignment assemblies 300. A wafer alignment assembly 300 may also be referred to as a subhead. A wafer polishing apparatus 100 may optionally include a different number of wafer alignment assemblies than shown in FIG. 1. A number of polishing heads included in a wafer polishing apparatus and a number of wafer alignment assemblies on each polishing head are related to the diameter of wafers to be polished. When the lid 110 is lowered to a closed position with the lower edges of the lid 110 resting on the base 102, wafers attached to the wafer alignment assemblies 300 may be pressed against the working surface of the polishing pad 108 by adjustable vertical travel in each polishing head's drive mechanism.

Figure 2:
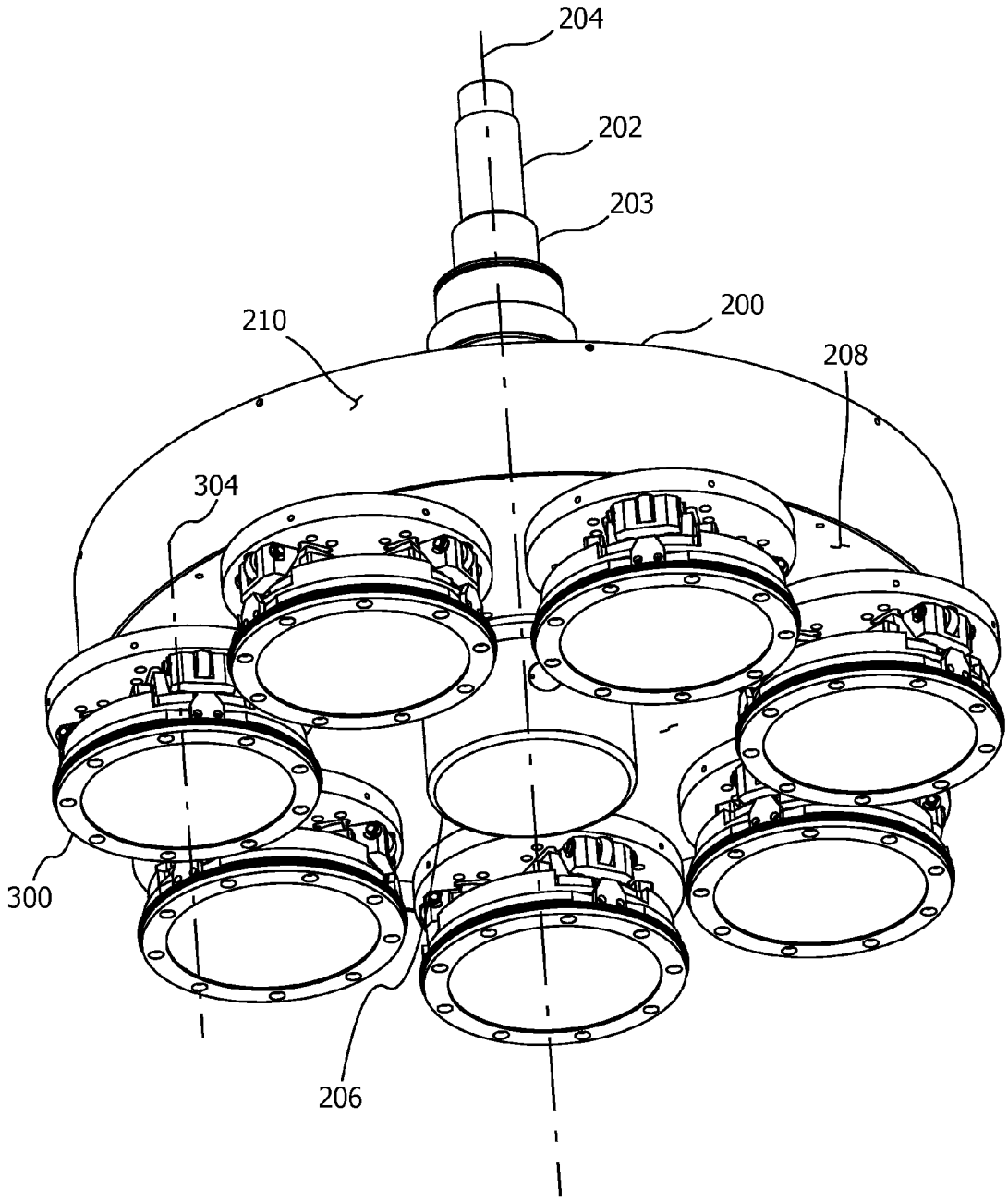
FIG. 2 illustrates a pictorial view of parts of a polishing head from the wafer polishing machine of FIG. 1, further illustrating seven wafer alignment assemblies spaced symmetrically around a vertical axis of rotation of the polishing head.

During wafer polishing, all of the wafer alignment assemblies 300 coupled to a single polishing head 200 rotate as a group about an axis of rotation of the polishing head 200. In FIG. 2, an axis of rotation 204 for the polishing head 200 is represented by a centerline passing through a long central axis of a polishing head drive shaft 202. The drive shaft 202 and outside shaft 203 may be rotatably coupled to a shaft housing 206 by a ball-and-socket joint as will be explained in reference to FIG. 14. Each wafer alignment assembly 300 is attached to a polishing head mounting plate 208 and may be rotated about its own axis of rotation 304, either in a same direction of rotation as the polishing head 200 or in an opposite direction of rotation, at a selected rate of rotation. FIG. 2 illustrates an example of a wafer alignment assembly axis of rotation 304 passing through a center point on a lower circular surface of one wafer alignment assembly 300; the other six wafer alignment assemblies will each have their own similarly positioned wafer alignment assembly axis of rotation. The polishing head axis of rotation 204 and the axis of rotation 304 for each of the wafer alignment assemblies 300 are approximately parallel to each other. When the lid of the wafer polishing machine is closed, the axes of rotation of the polishing head and wafer alignment assemblies (204, 304) are perpendicular to the working surface of the polishing pad. Furthermore, the axes of rotation 304 for each of the wafer alignment assemblies 300 are separated from the axis of rotation 204 of the polishing head by a same value of radial distance. A polishing head shield 210 protects belts, pulleys, and other components used for driving rotation of the wafer alignment assemblies 300 on the polishing head 200.

Figure 3:
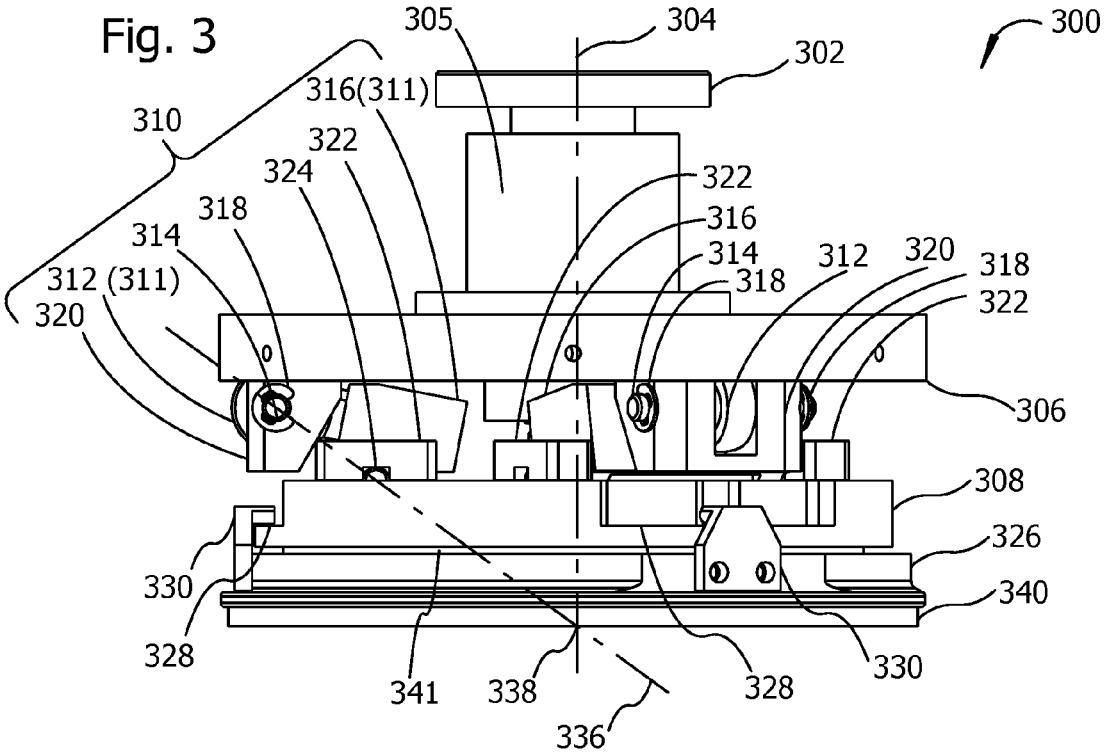
FIG. 3 illustrates a side view of an example of a wafer alignment assembly.
Figure 4:
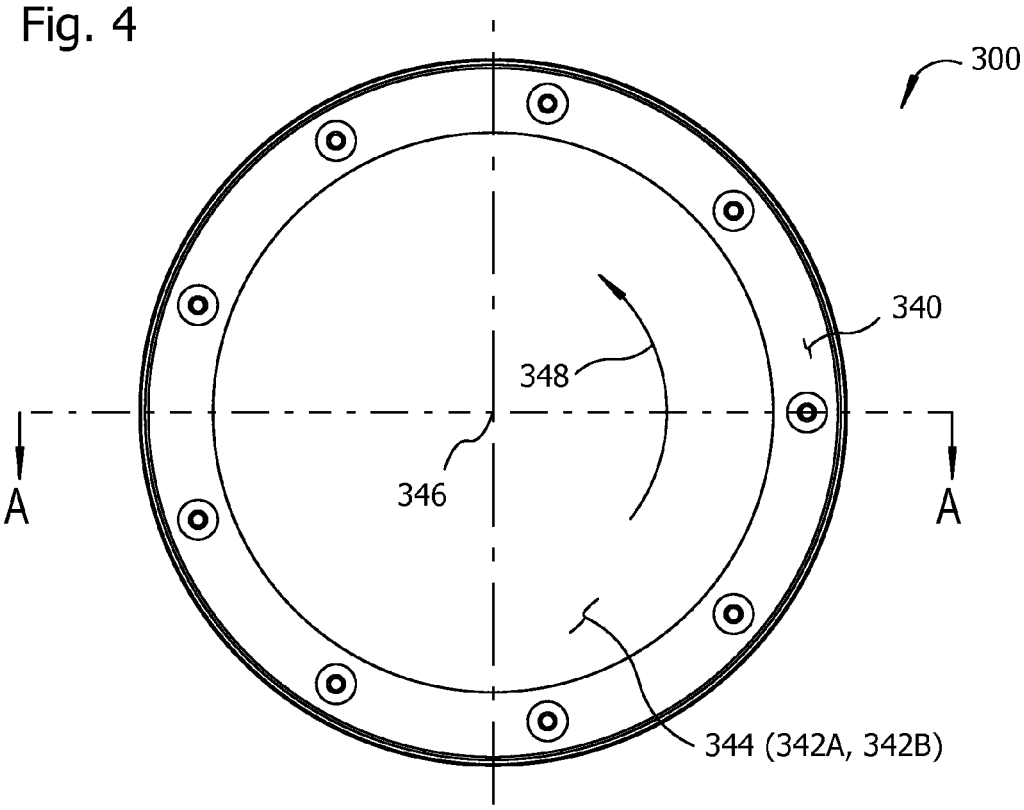
FIG. 4 illustrates a view toward a bottom surface of the wafer alignment assembly of FIG. 3.
Figure 5:
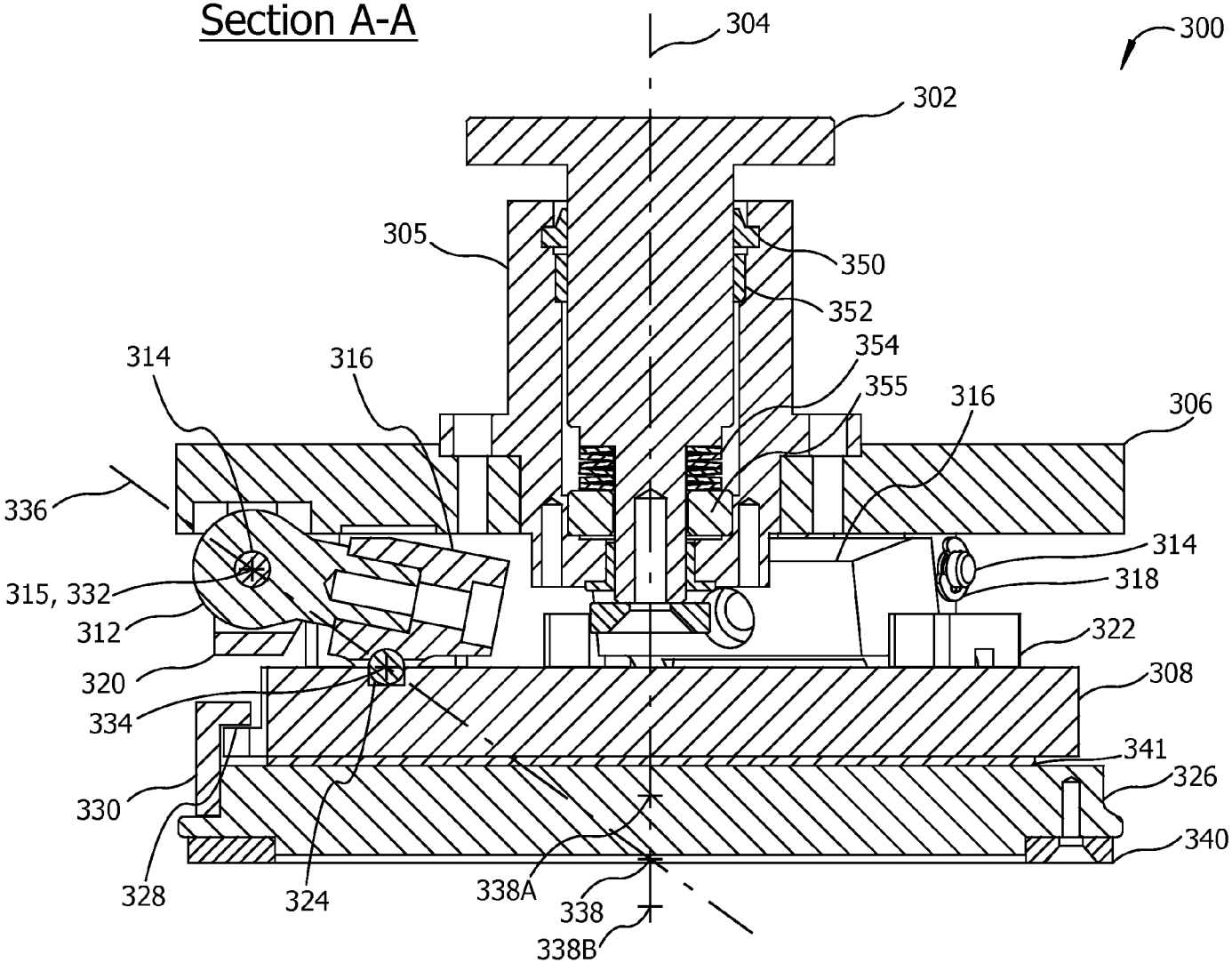
FIG. 5 illustrates a cross-sectional view of the wafer alignment assembly of FIGS. 3 and 4, taken along line A-A in FIG. 4.

The wafer alignment assembly 300 from the examples of FIG. 1 and FIG. 2 is shown in more detail in FIGS. 3-5. A side view of the wafer alignment assembly is shown in FIG. 3. FIG. 4 illustrates a view toward a bottom surface of the wafer alignment 300. In FIG. 4, a center point 346 represents an end view of the wafer alignment assembly axis of rotation 304 from FIG. 3. An arrow 348 represents a counterclockwise direction of rotation of the wafer alignment assembly 300. A wafer alignment assembly may alternately be rotated in clockwise direction. A retaining ring 340 has a large central aperture or indentation sized for a close fit of a wafer to be polished. An area inside the retaining ring 340 is representative of a wafer contact surface 344 against which a wafer may be held. The area inside the retaining ring 340 may alternatively represent a surface of a wafer insert 342B or the front surface of a wafer to be polished 342A.

FIG. 5 represents cross-section A-A of the wafer alignment assembly of FIGS. 3 and 4. As shown in the figures, the wafer alignment assembly 300 includes a telescoping shaft 302 for attaching the wafer alignment assembly to a polishing head. A wafer alignment assembly with a telescoping shaft is advantageous for uniformly distributing pressure across all the wafers on the same polishing head when there are more than three wafer alignment assemblies per polishing head. The wafer alignment assembly axis of rotation 304 passes through a central long axis of the telescoping shaft 302, the upper plate 306, and the lower plate 308. The vertical distance of shaft 302 to the upper plate 306 is self-adjustable during polishing to equalize the vertical forces between wafers mounted on the same polishing head. The shaft 302 slides on bearings 352 which are protected by a seal 350. The telescoping shaft 302 automatically adjusts a vertical position of the wafer alignment assembly 300 relative to the working surface of a polishing pad in response to changes in polishing pressure on the attached wafer, that is, pressure between the front face of a wafer and the working surface of the polishing pad. Such changes in pressure may result from, for example, differences in wafer thickness between wafers attached the same polishing head. In an embodiment of the invention comprising more than one wafer alignment assembly per polishing head, as in FIG. 2, the telescoping shafts 302 automatically equalize an amount of polishing pressure exerted on each of the wafers coupled to the polishing head.

Continuing with FIGS. 3-5, the wafer alignment assembly 300 is attached to a polishing head mounting plate by the telescoping shaft 302. The telescoping shaft 302 passes through a shaft housing 305 having seals 350 and slide bearings 352, and presses against a stack of conical disk springs 354, also referred to as Belleville washers 354. The slide bearings 352 allow rotation and vertical travel of the shaft housing 305 relative to the telescoping shaft 302. The vertical distance of the shaft 302 to the upper plate 306 is self-adjustable during polishing to equalize pressure on wafers mounted on the same polishing head. The slide bearings 352 permit rotation and vertical travel of the shaft housing 305 relative to the telescoping shaft 302. An upper plate 306 is attached to the shaft housing 305. A lower plate 308 is kinematically coupled to the upper plate by exactly three lever assemblies 310.

As shown in FIG. 3 and in cross-section near the left side of FIG. 5, a lever assembly 310 comprises an upper block 320, a lever 311, an upper part 312 of a lever with a spherical joint, a grooved headless pin 314, at least two e-clips 318, a hinge pin 324, a lower block 322, and a lower part 316 of the lever 311. The upper part 312 and the lower part 316 of the lever 311 are adjustably joined together by an optional threaded fastener (not illustrated). The upper part 312 of the lever 311 connects to the upper plate 306 by a grooved headless pin 314. The center 315 of the pin 314 passes though a point at the center of rotation 332 of a spherical joint at the upper part 312 of a lever 311. The lever 311 may rotate in any direction about the center of rotation 332 of the spherical joint in the upper part 312. The pin 314 passes through apertures in an upper block 320 attached to the underside of the upper plate 306. E-clips 318 retain the pin 314 in the upper block 320. The upper part 312 of the lever 311 may be implemented as a commercially available ball joint rod end having a movable spherical joint at one end. The upper part 312 of the lever 311 removably attaches to, or is alternately formed as an integral part of, a lower part 316 of the lever. The depth to which the lever 312 is installed inside an aperture in the lower part 316 of the lever is related to a length of the lever assembly 310 and is further related to an adjustable position for a vertical position of a gimbal point 338, as will be explained below. The depth may optionally be adjusted with a threaded fastener or by one or more shim washers (not shown) placed between the upper part 312 and lower part 316 of the lever.

The lower part 316 of the lever 311 is rotatably coupled to the lower plate 308 by a horizontal elongated cylindrical hinge having a hinge pin 324 passing through apertures in the lower part 316. The hinge pin 324 is held against the lower plate 308 by a pair of lower blocks 322, one on either side of the lower part 316. The hinge pin 324 has a central axis 334 along the longest dimension of the pin 324. The hinge pin 324 may optionally rest in an aperture in the upper surface of the lower plate 308 to reduce an overall thickness of a wafer alignment assembly. The lower part 316 of a lever assembly can rotate only in a vertical plane. The three levers 311 couple rotational torque around the wafer alignment assembly axis of rotation 304 from the upper plate 306 to the lower plate 308. A small amount of clearance between each lower part 316 and its adjacent pair of lower blocks 322 allows some self-alignment of the lever along pin 324.

The upper part 312 of each lever 311 is positioned close to the periphery of the upper plate 306 and the lower part 316 of each lever is positioned toward the wafer alignment assembly axis of rotation 304. In an alternative embodiment of a wafer alignment assembly 300 (not shown), the levers 311 are reversed from the orientation shown in FIG. 5, with the hinge pin 324 held against the underside of the upper plate 306 near the periphery of the plate and the spherical joint end of the lever 311 attached to the upper surface of the lower plate 308. In both alternative orientations of levers 311, a kinematic axis 336 of each lever 311 passes through the center 315 of pin 314 and intersects the central long axis 334 of the hinge pin 324, the center of rotation 332 of the spherical joint in the upper part 312 of a lever 311, and wafer alignment assembly axis of rotation 304. Preferably, components for lever assemblies 310 are selected so that all three kinematic axes 336 intersect at a common point on the wafer alignment assembly axis of rotation 304.

Figure 11:
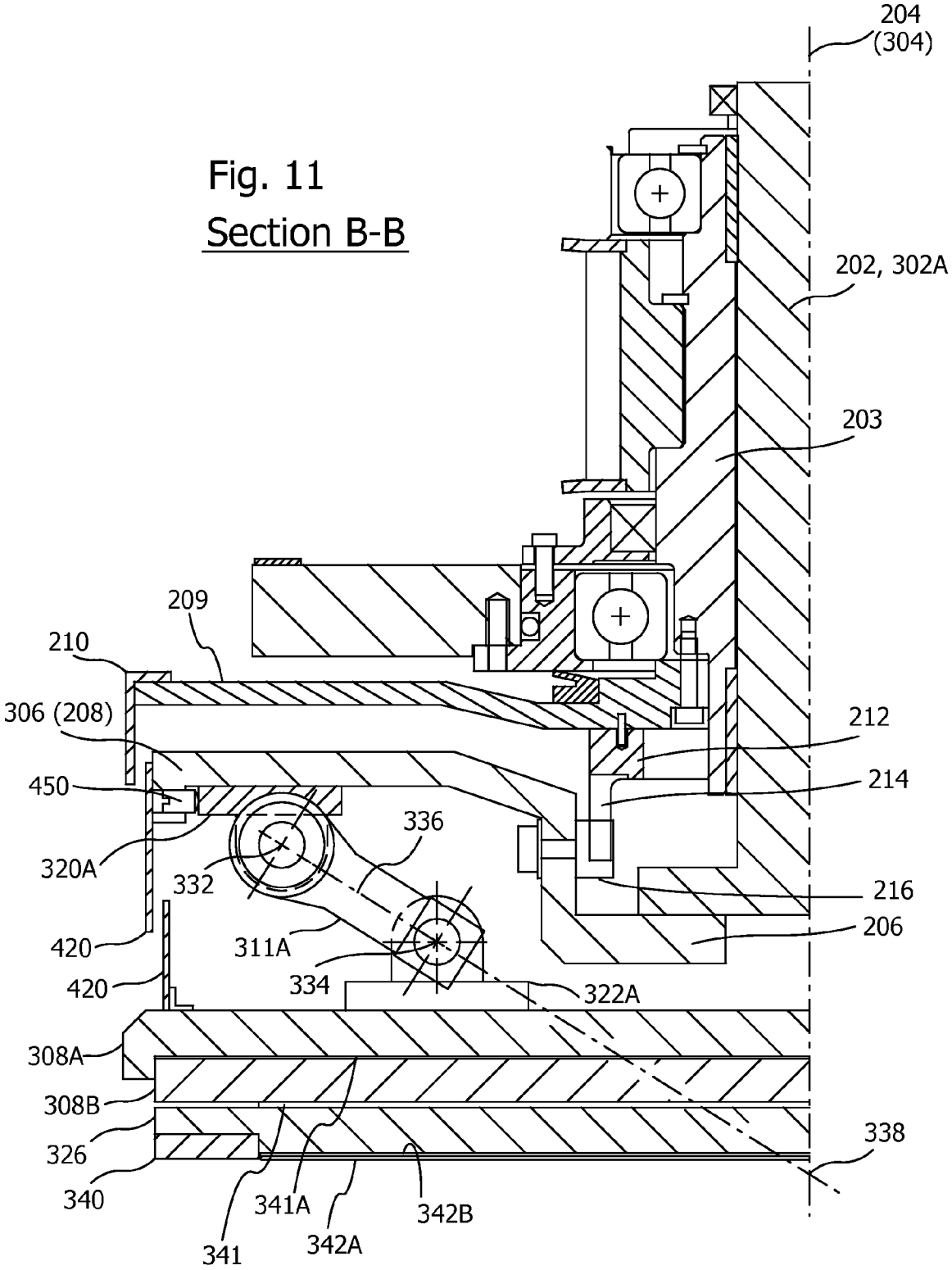
FIG. 11 illustrates a cross-sectional view of the embodiment of FIG. 10, taken along a line B-B as shown in FIG. 10.
Figure 12:
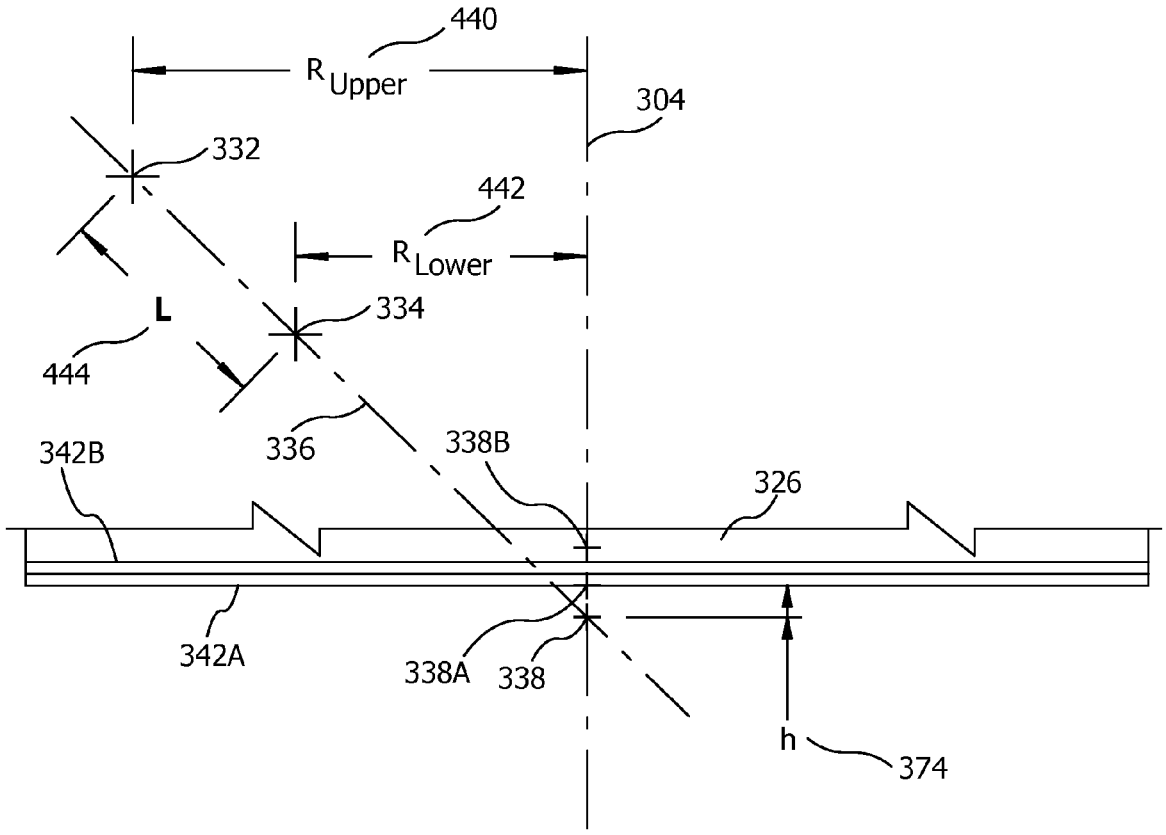
FIG. 12 illustrates spatial relationships between any one of three kinematic axes in a lever assembly and an axis of rotation of a wafer alignment assembly, showing a magnitude of vertical separation between a gimbal point and a bottom surface of the wafer alignment assembly.

The point of intersection between the three kinematic axes 336 and the axis of rotation 304 is defined as the gimbal point 338 for the wafer alignment assembly 300. The lower plate 308 can tilt relative to the upper plate 306 about the gimbal point 338. A wafer carrier 326 is latched to the lower plate. A wafer insert 342B is attached to the wafer carrier 326 as shown in FIG. 11. Returning to FIG. 5, a wafer to be polished attaches firmly to a bottom side of the wafer carrier 326 so that the lower plate, wafer carrier, and wafer move together as a single unit. During polishing a wafer may tilt in any direction about the gimbal point 338. Tilting motions of a wafer about the gimbal point 338 occur without relative sliding between parts with relative linear velocities of rotation around the gimbal point 338. As a result, the vertical position of the gimbal point 338 is not changed by friction between parts moving relative to the gimbal point. The vertical position of the gimbal point 338, represented by a distance "h" 374 in FIG. 12, is determined by the locations of the centers (332, 334) of pins (314, 324) in each lever assembly 310. The actual and ideal geometrical locations of the gimbal point 338 are coincident with sufficient accuracy to achieve high quality polishing under a wide variety of polishing conditions.

Figure 6:
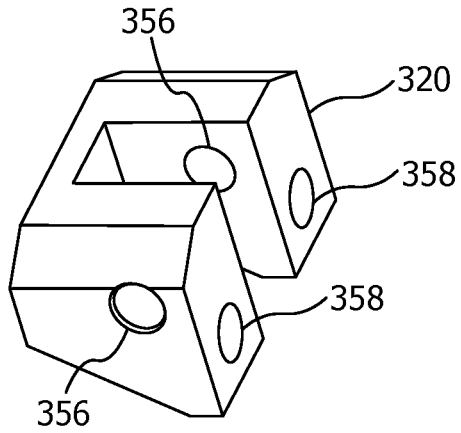
FIG. 6 shows an example of an upper block for a lever assembly.
Figure 7:
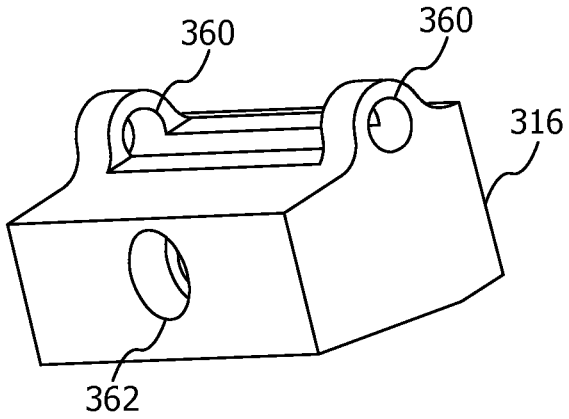
FIG. 7 shows an example of a lower part of a lever for a lever assembly.

Examples of some lever assembly components are shown in pictorial views in FIGS. 6-10. In FIG. 6, an upper block 320 includes two apertures 358 for clearance fit of threaded fasteners used to retain the upper block 320 against an upper plate in a wafer alignment assembly. The upper block 320 also includes a pair of apertures 356 for a clearance fit of a grooved headless pin used to hold a lever in a central channel in the upper block 320. In FIG. 7, a lower part 316 of a lever includes apertures 360 through which a hinge pin, for example the hinge pin 324 of FIG. 3, is inserted. An aperture 362 is provided in the lower part 316 for a sliding fit of an upper part of a lever, for example the upper part of a lever 312 of FIG. 8. One or more shim washers (not illustrated) may optionally be placed within the aperture 362 to adjust a length of the lever 311 and correspondingly adjust a related vertical position of a gimbal point.

Figure 8:
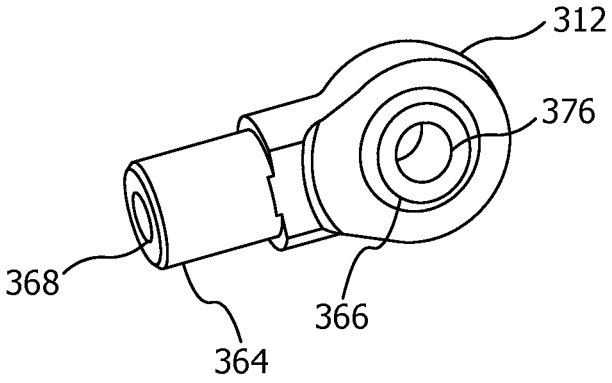
FIG. 8 shows an example of a spherical joint near an end of the upper part of the lever for a lever assembly.
Figure 9:
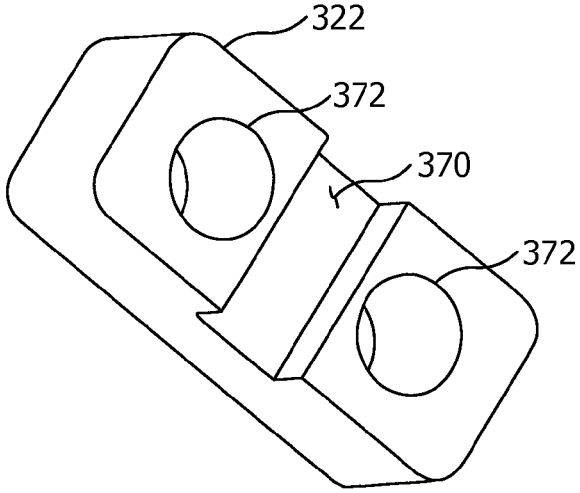
FIG. 9 shows an example of a lower block for a lever assembly.

The upper part of a lever 312 of FIG. 8 includes a movable spherical joint 366 which may be rotated in any direction relative to the shaft 364. The shaft 364 is formed with a central threaded aperture 368 for retaining the upper part of the lever 312 in the aperture 362 of the lower part 316 of the lever. An overall length of a lever may optionally be adjusted by inserting shims in the aperture 362 between the upper part of a lever 312 and the lower part of the lever 316. The movable spherical joint 366 is formed with a central aperture 376 sized for a clearance fit of a grooved headless pin, for example the grooved headless pin 314 in FIG. 5. FIG. 9 shows an example of a lower block 322 having a channel 370 sized for a close clearance fit of a hinge pin, for example the hinge pin 324 of FIG. 5, and a pair of apertures 372 sized for a clearance fit of a threaded fastener for retaining the lower block 322 against a lower plate in a wafer alignment assembly.

Figure 10:
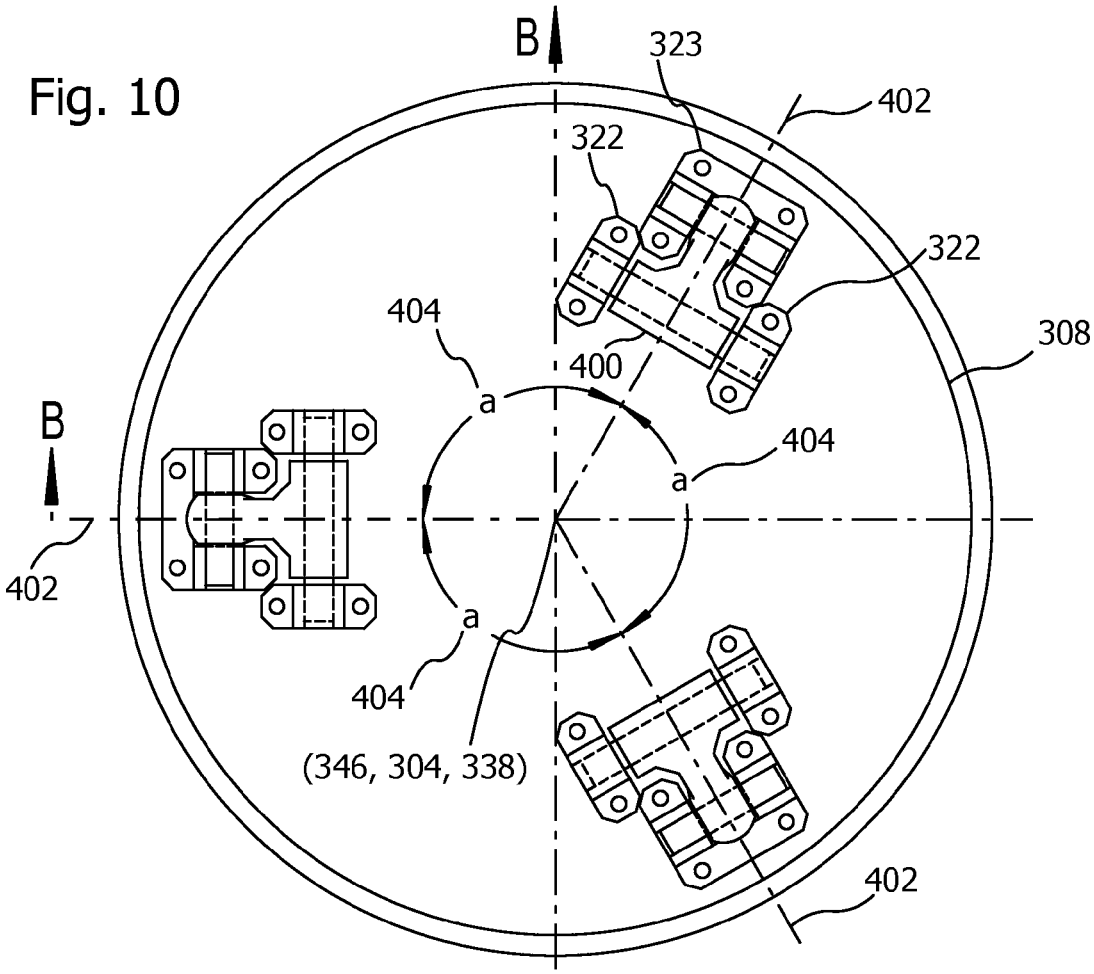
FIG. 10 illustrates a partial top view of a lower plate of a wafer alignment assembly included in an embodiment of a polishing head with only one wafer alignment assembly for polishing only one wafer per polishing head.

FIG. 10 shows an embodiment of polishing head with just one wafer alignment assembly. In this embodiment, the axis of rotation of the wafer alignment assembly is coincident with the axis of rotation of the polishing head. FIG. 10 illustrates a view toward the top of a lower plate 308 in a wafer alignment assembly in which the upper plate has been removed to show an equal angular separation "a" 404 between three lever assemblies 400. FIG. 10 is also representative of an equal angular separation "a" for three lever assemblies 310.

The lever assemblies 400 in FIG. 10 represent an alternative to the embodiment of a lever assembly in which an upper block and a lever are formed as an integral part. The alternative embodiment of a lever assembly 400 is retained against the upper and lower plates by hinge pins shown as hidden lines within lower blocks 322. Each lever assembly 400 has a centerline 402 intersecting at a center point 346 of the lower plate 308. The center 348 of the lower plate 308 corresponds to a position of the wafer alignment axis of rotation 304, the position of the gimbal point 338, and the position of the center point 346 of the wafer contact surface in the viewing direction represented in FIG. 10.

Figure 13:
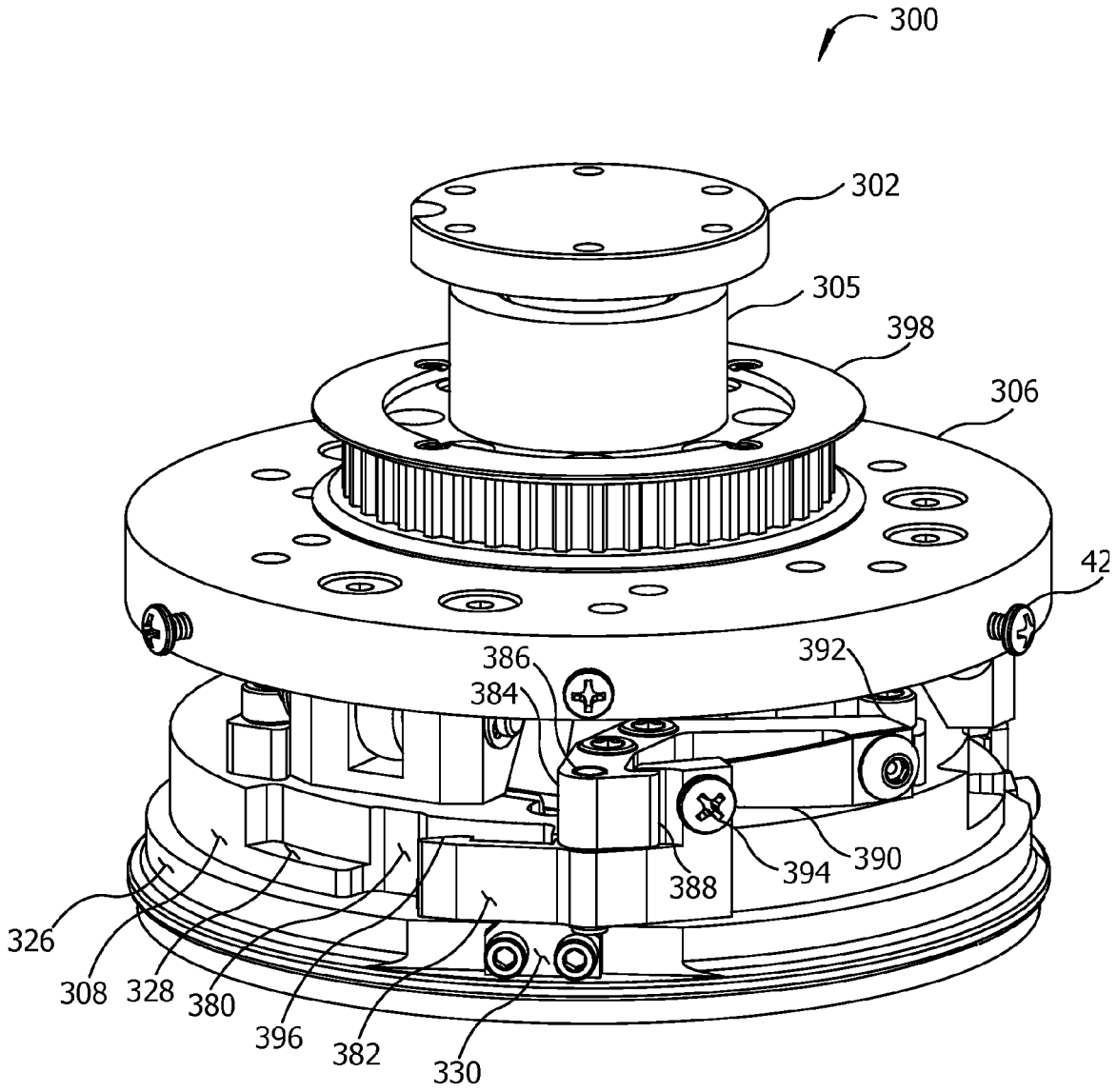
FIG. 13 illustrates a pictorial view of the wafer alignment assembly of FIG. 3 and FIG. 5.

The embodiment of a wafer alignment assembly illustrated in FIGS. 3, 5, and 13 includes a telescoping shaft 305. Wafer alignment assemblies with telescoping shafts are preferred for attachment to polishing heads having more than three wafer alignment assemblies. Telescoping shafts contribute to equalization of polishing pressure for all of the wafers coupled to a polishing head. Alternatively, a wafer alignment assembly may be provided with a non-telescoping shaft. Such an arrangement may be preferred when just one wafer is to be coupled to a polishing head, as may be the case for example with large semiconductor wafers. A partial cross-sectional view of an example of a wafer alignment assembly for a polishing head having only one wafer alignment assembly is illustrated in FIG. 11. A location of the cross section is marked by line B-B in FIG. 10. FIG. 11 further illustrates some features that may be in common with an embodiment with three or more wafer alignment assemblies on one polishing head.

In the example of FIG. 11, the wafer alignment assembly axis of rotation 304 is coincident with the polishing head axis of rotation 204, which is preferred when just one wafer is to be polished on each polishing head. For polishing of a single wafer per polishing head, the non-telescoping wafer alignment assembly drive shaft 302A is optionally formed integrally with the polishing head inside shaft 202, which may be adjusted for vertical travel by motion relative to the polishing head outside shaft 203. A polishing head mounting plate 208 is attached to an end of the drive shaft 302A. A shaft housing 206 is also attached to the drive shaft 302A. A shaft housing 206 may optionally be formed as an integral part of the mounting plate 208.

Continuing with FIG. 11, inside parts of the polishing head are protected from water and polishing slurry by a shield 210 attached to a polishing head top plate 209. The top plate 209 and a fork 212 are firmly attached by fasteners to the shaft 203. The fork 212 has two equally spaced slots 214 which open in a downward direction. A cam 216 attached to the shaft housing 206 engages with the slots 214 in the fork 212. The length of the slots 214 allow vertical travel of the cams 216 resulting from vertical travel of the polishing head.

An elastic gasket 341 (FIGS. 3, 5, 11) attached to bottom of the lower plate 308 uniformly distributes pressure to the wafer carrier 326 and corrects for deviations from flatness in the lower plate. An alternative design of the lower plate may be provided as two parts separated by a second elastic gasket. An example of a two-part lower plate is shown in FIG. 11. An upper part 308A of the two-part lower plate is kinematically coupled to the upper plate 306 by three lever assemblies. The upper plate 306 in FIG. 11 incorporate some of the features of a polishing head mounting plate 208 as shown in the example of FIG. 2. The polishing head drive shaft 202 provides the vertical travel function of the telescoping shaft 302 in some embodiments of a wafer alignment assembly, for example as shown in FIG. 3 and FIG. 5. In the example of FIG. 11, central axes of rotation for a wafer being polished, wafer alignment assembly, and the polishing head all coincide.

Continuing with FIG. 11, an elastic gasket 341A is placed between the upper part 308A and a lower part 308B of the two-part lower plate in order to make distribution of pressure on the lower plate more uniform. Each gasket may alternatively be formed as a disk, a set of concentric rings, or a disk with apertures. Each lever assembly comprises a lever 311A having a spherical joint with a center of rotation 332, a hinge with a hinge pin having a central long axis 334 for linking the lever 311A to a lower block 322A. A lever 311A may optionally have a fixed length between the center of rotation 332 of the spherical joint and the central axis of the horizontal hinge pin 324, as suggested in FIG. 11. The lever 311A is coupled to an upper block 320A which may be adjusted by an adjustment screw 450 to change a radial distance separating the center of rotation 332 of the spherical joint from the wafer alignment assembly axis of rotation 304. All three upper blocks 320A are preferably set a same magnitude of radial distance from the center axis of rotation 204. The kinematic axis 336 of the lever assembly and gimbal point 338 for the embodiment shown in FIG. 11 passes through hinge centers (332, 334) in the lever 311A as explained for embodiments of lever assemblies in relation to FIG. 12. A vertical position of the gimbal point 338 along the wafer alignment assembly axis of rotation 304 may be selected by suitable adjustment of the adjustment screw 450. Alternatively, a vertical position for the gimbal point 338 may be selected by changing a length of each lever 311A, where the lever length is defined as shown by "L" 444 in FIG. 12. Covers 420 attached to the upper plate 306 and upper part 308A of the two-part lower plate protect the levers and other parts from water and polishing compound.

FIG. 12 represents a simplified view of geometry associated with a vertical position of a gimbal point. As shown in FIG. 12, the vertical position of a gimbal point 338 along a wafer alignment assembly axis of rotation 304 is determined by an intersection of a kinematic axis 336 for each lever assembly, one of which is represented in FIG. 12, with the kinematic axes for the other lever assemblies and with the wafer alignment assembly axis of rotation 304. A position of the kinematic axis 336 is determined by a line intersecting the center of rotation of the spherical joint 332 in a lever 311, the central axis 334 of a hinge pin 334, and the wafer alignment assembly axis of rotation 304. A vertical separation distance "h" 374 between a bottom surface of a wafer to be polished, corresponding to the plane of the wafer-pad interface, and the gimbal point 338 is related to a magnitude of torque acting to cause a wafer being polished to rotate away in vertical plane from the plane of a polishing pad. By suitable positioning of the kinematic axis 336, an embodiment of the invention may operate with "h" 374 essentially equal to zero and the related value of torque also essentially equal to zero. Alternatively, "h" 374 may be selected to have positive (gimbal point above interface) or negative (gimbal point below interface) values in order to achieve optimal polishing of a wafer.

A wafer to be polished 342A may be placed on top of a wafer insert 342B in the wafer carrier 326 of FIG. 11. The thin, flat insert 342B may optionally be placed on the lapped, flat surface of the carrier 326 serves to provide more uniform pressure on the wafer 342A. The wafer carrier 326 is attached to a bottom surface of the lower part 308B of the two-part lower plate. A gasket 341 may be placed between the wafer carrier 326 and the lower part 308B of the lower plate. A retaining ring 340 attached to the wafer carrier 326 holds the wafer in place during polishing. When the value of "h" 374 is zero, as shown for example by a point 338A in FIG. 12, there will be no torque in a vertical plane acting on the wafer during polishing, and pressure on the wafer will be uniform at all points on the front face. For some polishing conditions, for example when more slurry is supplied to the leading edge of a wafer than to the trailing edge, it may be preferable to place the gimbal point a selected distance below the wafer-pad interface, as illustrated by point 338 in FIG. 12. Or, the gimbal point may optionally be placed above the wafer-pad interface as shown at point 338B in FIG. 12. A non-uniform distribution of pressure across the front face of a wafer is selected when the gimbal point is located at point 338, point 338B, or other points separated vertically from point 338A.

FIG. 13 illustrates a pictorial view showing more features of the wafer alignment assembly of FIGS. 3-5. In FIG. 13, a timing belt pulley 398 for driving the wafer alignment assembly in rotation relative to a polishing head is located on the upper surface of the upper plate 306 and is concentric with the telescoping shaft 302 and shaft housing 305. A timing belt coupled to the timing belt pulleys on each of the wafer alignment assemblies provides synchronous rotation of the wafers on the polishing head for uniformly polishing all wafers to a same condition of quality. a plurality of screws 422 are provided for attachment of a cover (not shown) to protect the mechanism of the wafer alignment assembly 300.

Figure 15:
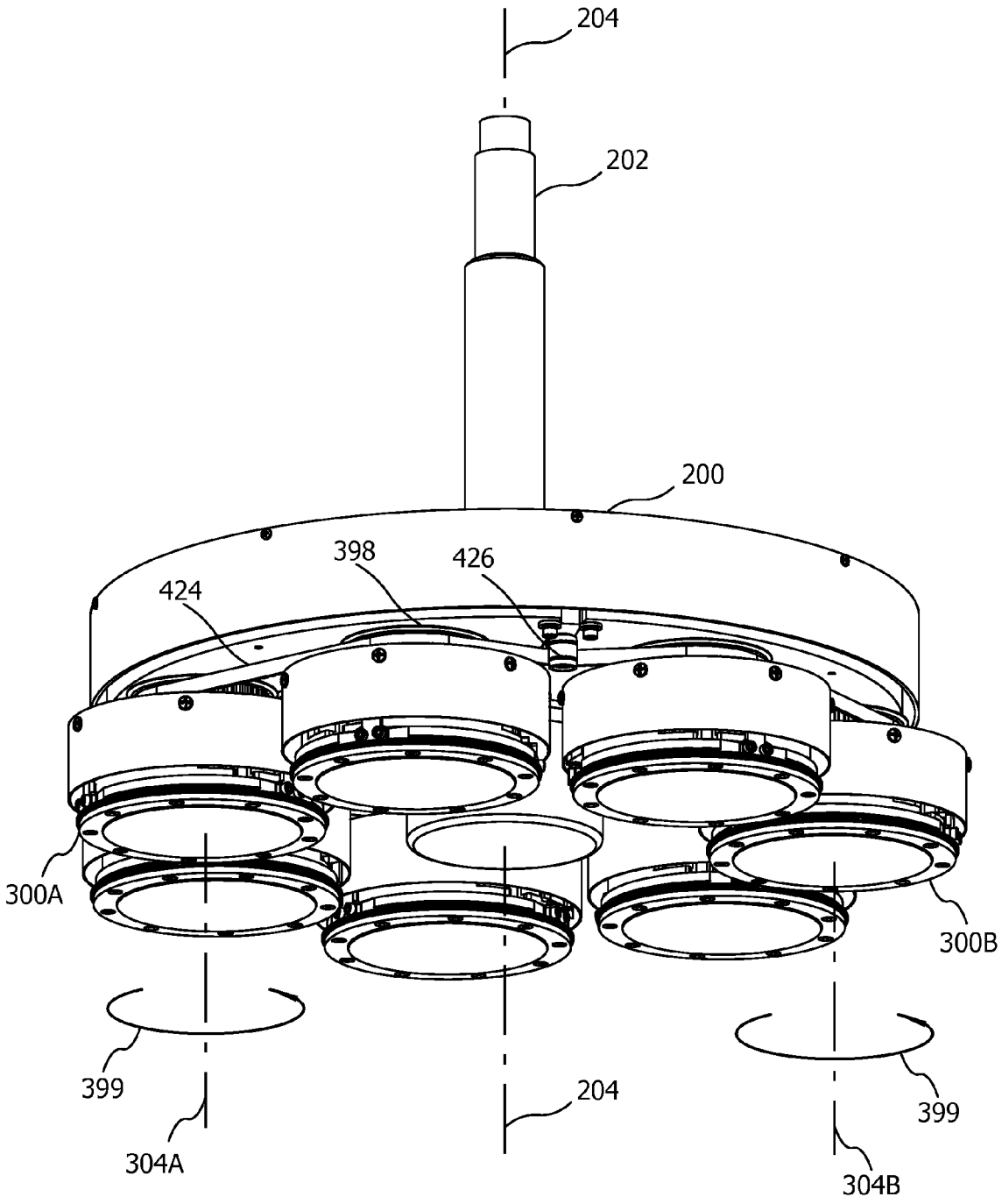
FIG. 15 illustrates a pictorial view of parts of a polishing head from the wafer polishing machine of FIG. 1, further illustrating a timing belt for synchronously rotating all of the wafer alignment assemblies at a same selected rate of rotation and in a same selected direction of rotation.

An example of a timing belt 424 is shown in FIG. 15. The timing belt 424 engages a tension pulley 426. The timing belt 424 causes each of the wafer alignment assemblies on a same polishing head to rotate at a same rate of rotation and in a same direction of rotation. For example, the timing belt 424 in FIG. 15 causes a first wafer alignment assembly 300A to rotate in a selected direction of rotation 399 about an vertical axis of rotation 304A passing through a center of a wafer attached to the wafer alignment assembly. A second wafer alignment assembly 300B rotates about its own axis of rotation 304B in a same selected direction of rotation 399 and at a same rate of rotation as the first wafer alignment assembly 300A.

The lower plate 308 of a wafer alignment assembly (FIGS. 3, 5, 13) includes horizontal ribs 328. A wafer carrier 326 is removably attached to the lower plate 308 by three hooks 396 and three hook plates 330 for engaging the ribs 328. The hook plates 330 are affixed to the wafer carrier 326 by fasteners. The ribs 328 have vertical slots 380 that allow the hooks 396 to slide vertically over the ribs 328 and then rotate with the carrier 326 for engagement over the ribs 328. A hook assembly comprises a hook plate 330 and a rib 328. There are three similar arrangements (i.e., three hook assemblies) of the hook plates 330 and the ribs 328 with the slots 380 on the periphery of the lower plate 308 and carrier 326. The hook assemblies cooperate to hold carrier 326 centered on the lower plate 308. In an alternative embodiment of the invention (not shown), the position of the hook assemblies could be reversed, with hook plates 330 on the upper plate 306 and ribs 328 on lower plate 308. A spring loaded latch 382 and a latch mount 384 on the lower plate secure the carrier 326 against rotation relative to the lower plate 308 and prevent unintentional disengagement from the lower plate 308. The latch 382 is mounted on the latch mount 384 by a latch pin 386. The latch 382 is held against a latch stop 388 on the latch mount 384 by a flat spring 390 attached at one end to a latch mount end 392 of the latch mount 384. On the end of the latch 382 opposite to its spring loaded end there is a latch hook 396. When the hook plate 330 with its hook moves over the rib 328 to the end of their engagement the hook plate 330 slides under the wedged side of the latch hook 396 by pushing it to outward. At the end of its engagement the latch hook 396 catches and holds the hook plate 330 in a locked position. A plastic screw 394 attached to the latch 382 provides adjustment for the spring 390 and also provides a convenient location for a polisher operator to press the latch 382 against the flat spring 390, disengage the latch 382 from holding the hook plate, and separate the wafer carrier 326 from the lower plate 308.

Figure 14:
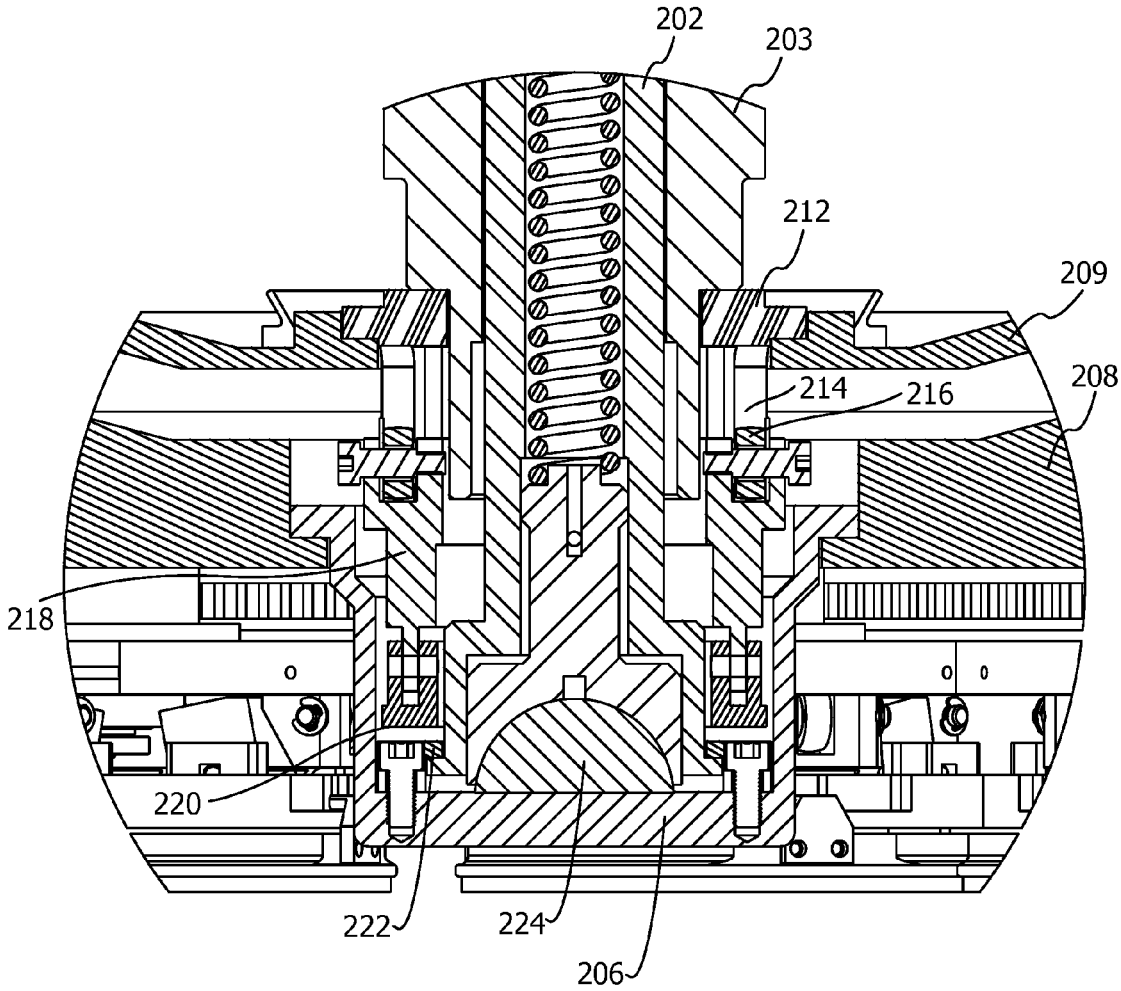
FIG. 14 illustrates a partial cross-sectional view of a polishing head with a spherical ball-and-socket joint, taken along a cutting plane passing through the axis of rotation of the polishing head of FIG. 2.

Referring now to FIG. 14, which illustrates a partial cross-sectional view of the polishing head of FIG. 2 with a cutting plane taken through the polishing head axis of rotation, it may be seen that a polishing head inside shaft 202 may be coupled to a shaft housing 206 and thence to the polishing head mounting plate 208 by a ball and socket joint 224. A fork 212 with vertical slots 214 guides cams 216 as earlier described. A universal joint coupled to the inside of the shaft housing 206 comprises an upper end 218, a middle link 220, and a lower end 222. Cams 216 are mounted on the upper end 218 of the universal coupling. The lower end 222 is firmly fastened to the shaft housing 206. The polishing head 208 and the housing 206 are firmly fastened together by flanges. The driving torque of the shaft 203 transfers to the fork 212, then to the cams 216, through the universal joint (218, 220, 222) to the housing 206 and to the polishing head mounting plate 208. The shaft housing 206 together with mounting plate 208 can swivel for small angles around ball and socket joint 224. The wafer alignment assemblies coupled to the polishing head of example of FIG. 14 provide better equalization of pressure across the front face of each wafer than would be achieved by a polishing head having only a ball-and-socket joint. Furthermore, a polishing head with subheads with wafer alignment assemblies 300 having a ball-and-socket joint optimally distributes pressure across the front face of each wafer and equalizes pressure applied to separate wafers being polished on the same polishing head. A polishing head in accord with an embodiment of the invention is therefore able to achieve optimal polishing conditions for a wide range of polishing parameters such as wafer size, slurry type, and other factors as previously explained.

Referring to both FIG. 12 and FIG. 14, the center of rotation 332 of the spherical joint in the upper part of the lever is separated from the wafer alignment assembly axis of rotation 304 by a lateral distance $R_{Upper}$ 440. The central axis 334 of the hinge pin in the lower part of the lever is separated from the wafer alignment assembly axis of rotation 304 by a lateral distance $R_{Lower}$ 442. A lever length is defined as a separation between hinge centers (332, 334) and is represented by a distance "L" 444 in FIG. 12. Values for "h" 374 may be made positive (gimbal point 338 above the bottom surface of the retaining ring 340), zero (gimbal point coincident with wafer-pad interface), or negative (gimbal point below the wafer-pad interface) by suitable choice of values for "L" 444, $R_{Upper}$ 440, and $R_{Lower}$ 442. Values for "L" 444 may be changed by replacing these levers with levers having a different length.

When the gimbal point 338 is coincident with the wafer-pad interface, that is, when "h" 374 in FIG. 12 is equal to zero, the pressure between the front face of the wafer and the working surface of the polishing pad will be uniform at all points on the wafer's front face. The larger the absolute value of "h" 374, the greater the variation in pressure across the front face of the wafer being polished. Selectively positioning the gimbal point 338 vertically along the wafer alignment assembly axis of rotation causes more pressure to be applied to either the leading edge or trailing edge of a wafer being polished. Moving the gimbal point upwards or downwards may be desirable to correct for alignment errors between moving parts of a wafer polishing machine or to optimize polishing under new conditions of polishing slurry flow rate, type of polishing slurry, number and diameter of wafers, and other operational parameters. In an example of a wafer polishing apparatus with four polishing heads 200 and seven wafer alignment assemblies 300 per polishing head, as illustrated in FIG. 1 and FIG. 2, each wafer alignment assembly 300 is adapted to carry a 4 inch (100 millimeter) diameter wafer and the gimbal point 338 is set to a vertical distance "h" 374 of 0.094 inch (2.4 millimeters) below the wafer-pad interface. The distance "h" may readily be adjusted above or below the wafer-pad interface, for example by adjusting a length L 444 of a lever 311 as in FIG. 12 and FIG. 5, or by selecting a suitable fixed-length lever 311A with a length L 444 as in FIG. 11 and FIG. 12. Changing the vertical position of a gimbal point may be achieved without changing the major parts of the alignment mechanism.

The distance "h" 374 is generally small in comparison to dimensions of other parts of a wafer alignment assembly. Therefore, the position of the gimbal point may be selected to be on the axis of rotation of alignment mechanism in proximity to wafer-pad interface. For example, the distance from a gimbal point to the wafer pad interface may be selected to be in a range from about −⅛ to about +⅛ of the diameter of a polished wafer.

After selecting a distance "h" for a gimbal point and adjusting lever assemblies to operate with the selected gimbal point location, wafers are then installed on the bottom of each wafer carrier 326 on the wafer alignment assemblies 300. Embodiments of the invention maintain "h" at a stable value until the value is deliberately changed to accommodate a desired change in polishing parameters associated with a polishing process. A wafer may be attached directly to the bottom of a wafer carrier 326, or inserts or other means of positioning or attaching a wafer to a wafer carrier may optionally be used. During polishing, a wafer preferably does not move relative to the wafer carrier to which the wafer is attached. The front surface of the wafer projects beyond the lowest surface of the wafer carrier so that the wafer front surface may contact a polishing pad during polishing. Next, a wafer carrier 326 is attached to a lower plate 308 on a wafer alignment assembly 300. Referring to FIG. 5 and FIG. 13, a wafer carrier 326 may be attached to a lower plate 308 of a wafer alignment assembly by aligning the hooks of the three hook plates 330 to the vertical slots 380 of the lower plate 308 and moving the wafer carrier 326 up until the hooks of the hook plates 330 engage the ribs 328 when the carrier is rotated relative to the lower plate 308. During rotation of the wafer carrier 326 one of the hook plates 330 will meet the wedged back side of the latch hook 396, push it outward, i.e., away from the rotational axis of the wafer alignment assembly, and past the hook latch 396. This will lock the hook plate 330 in place and will also lock the carrier 326 on the wafer alignment mechanism 300 during polishing process for attached wafers.

The orientation of the latch 382 on the lower plate 308 is arranged so that during polishing process frictional rotational torque of the polishing pad 108 on the carrier 326 is directed to rotate the carrier 326 relative to the lower plate 308 in a direction causing the hook plate 330 and the latch 382 to engage more firmly. In an alternative embodiment, the hook 396 and related parts may be made to support rotation of the wafer alignment assembly in a direction opposite to the rotation direction preferred for the example of FIG. 13. After the polishing is finished, the wafer carrier 326 may be removed by pushing the head of screw 394, thereby moving the hook 396 of the latch 382 outward and allowing the hook plate 330 to move to the vertical slot 380 with carrier 326 rotation relative to the lower plate 308. The wafer carrier 326 may then be removed from the wafer alignment assembly 300.

After wafers are installed on the polishing heads 200, the lid 110 of the wafer polishing machine 100 may be moved into its closed position, with the front surfaces of the wafers to be polished parallel to the polishing pad 108. Rotation of turntable 106 is turned on, the slurry supply to the polishing pad is turned on, rotation of the polishing heads is turned on, and then the polishing heads are lowered for the wafer contact with the polishing pad 108. Next, a selected amount of downward vertical force is applied to each polishing head 200 for applying a selected amount of contact pressure between each wafer being polished and the working surface of the polishing pad at the wafer-pad interface. In batch processing with several wafers per polishing head 200, the polishing head mounting plate 208 can swivel around the ball and socket joint 224 until all wafers of the head are approximately aligned for touching the polishing pad 108 with approximately equal pressure. However, because of differences in wafer thickness between wafers attached to a same polishing head, this pressure will be not equal. The telescoping shaft 302, telescoping shaft housing 305, Belleville washers 354, and angular ball bearing 355 automatically adjust a vertical position of each wafer relative to the wafer-pad interface to approximately equalize polishing pressure on all wafers attached to the polishing head. Deflection of the of the Belleville washers 354 compensates for the difference in thickness of the wafers to equalize the pressure on the wafers. This automatic adjustment eliminates the step conventionally followed with previously known polishing machines of sorting the wafers according to wafer thickness, and also improves the quality of polished wafers, especially the flatness of the wafers.

As shown in FIG. 5, the telescoping shaft housing 305 attaches to the upper plate 306 and is able to rotate freely relative to the shaft 302. One or more bearings 352 between the upper and lower parts of the shaft 302 lower the friction from horizontal forces and an angular ball bearing 355 lowers the friction from vertical downward pressure forces. In contrast to this arrangement, in previously known polishing machines the corresponding bearings are larger and serve more than one function, for example alignment and rotation, and have higher parasitic friction that negatively effects the quality of the polishing. Furthermore, in previously known wafer polishing machines, subheads connected to a same polishing head may rotate at different speeds, reducing polishing quality. In embodiments of the invention, for example in the embodiment illustrated in FIGS. 1, 2 and 13 all wafer alignment assemblies attached to a same polishing head are coupled to one drive belt and rotate synchronously at a same rate of rotation.

In an embodiment of a wafer polishing machine adapted for polishing of only one wafer per polishing head, as in the example of FIG. 11, a means for equalizing pressure between multiple wafer alignment assemblies may optionally be omitted. For example, in FIG. 11, parallel alignment of front surface of a wafer being polished and the working surface of a polishing pad is achieved only by a wafer alignment assembly attached coaxially with a polishing head. Wafer rotation during polishing is achieved in the embodiment of FIG. 11 by rotation of the polishing head and not by separate rotation of the wafer alignment assembly. The driving shaft 203 transfers the rotational torque to the mounting plate 208, which also functions as the upper plate 306 of the wafer alignment assembly. The levers 311 prevent relative rotational motion of the lower 308 and upper 306 plates around vertical axis 304 because of the presence of hinge pins 324, which form cylindrical hinges. Therefore, the rotation of the upper plate 306 directly transfers to the rotation of the lower plate 308 (or alternatively to the upper 308A and lower 308B parts of a two part lower plate) and then to the wafer carrier 326 and the wafer being polished. Rotation is transferred to the lower plate without any undesirable torque in a vertical plane.

A method of polishing a plurality of wafers on a polishing machine in accord with an embodiment of the invention comprises:

attaching a wafer to be polished to a wafer carrier, the attachment optionally being accomplished with, for example but not limited to, a pressure sensitive adhesive, a wax, or a free insert;

attaching the wafer alignment assembly to a polishing head rotatably coupled to a lid of a wafer polishing apparatus;

attaching the wafer carrier to a wafer alignment assembly, the attachment optionally being accomplished with at least three hook assemblies;

selecting a gimbal point vertical position for the wafer alignment assembly on a vertical axis of rotation of the wafer alignment, thereby causing a wafer being polished to pivot about a point on a selected side and at a selected distance from the wafer-pad interface;

optionally selecting an optimal distance of the gimbal point from the wafer-pad interface in a range of values from −⅛ to ⅛ of the diameter of the wafer being polished, wherein negative values refer to a position below the wafer-pad interface and positive values refer to a position above the wafer-pad interface;

optionally, selecting a gimbal point vertical position coincident with the wafer pad interface;

rotating the polishing pad in a first selected direction at a first selected rate of rotation;

rotating the polishing head in a second selected direction of rotation at a second selected rate of rotation;

rotating the wafer alignment assembly around an axis through the center of the wafer being polished, in a third selected direction at a third rate of rotation;

rotating all of the wafer alignment assemblies on a polishing head at a same rate of rotation and in a same direction of rotation;

lowering the polishing head of the wafer polishing apparatus until the wafer contacts a working surface of a polishing pad;

adjusting an amount of contact pressure between the wafer being polished and the polishing pad;

optionally, rotating the wafer alignment assembly in a third selected direction and at a third selected rate of rotation around a separate center of rotation for each wafer alignment assembly; and polishing the wafer until the wafer surface being polished has selected properties of flatness.

The method described above may optionally comprise any of the following steps, singly or in combination:

selecting a vertical position of the gimbal point so as to cause more pressure to be applied to a trailing edge of the wafer being polished than to a leading edge;

selecting a vertical position of the gimbal point so as to cause more pressure to be applied to a leading edge of the wafer being polished than to a trailing edge;

selecting a vertical position of the gimbal point to a point below the working surface of the polishing pad; and automatically adjusting an amount of contact pressure between a batch of wafers on one polishing head and the polishing pad.

It will be appreciated that many alternatives to the previously described method may be performed by performing selected steps in an order that differs from the order of steps shown above.

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, or use of equivalent functional steps for steps described herein. Such insubstantial variations are to be considered within the scope of what is contemplated here. Moreover, if plural examples are given for specific means, or steps, and extrapolation between or beyond such given examples is obvious in view of the present disclosure, then the disclosure is to be deemed as effectively disclosing and thus covering at least such extrapolations.

Unless expressly stated otherwise herein, ordinary terms have their corresponding ordinary meanings within the respective contexts of their presentations, and ordinary terms of art have their corresponding regular meanings.

What is claimed is:

1. A wafer polishing apparatus, comprising:

a lower frame;

a base mounted on said lower frame;

a turntable having an upper surface and a turntable axis of rotation, wherein said turntable is rotationally coupled to said base;

a polishing pad removably attached to said upper surface of said turntable, wherein said polishing pad includes a work surface for wafer polishing;

an upper frame movably coupled to said base;

at least one polishing head rotatably coupled to said upper frame;

at least one drive mechanism mounted on upper frame wherein each of said at least one polishing head further comprises a polishing head axis of rotation parallel to and not coincident with said turntable axis of rotation, and each of the at least one polishing head is coupled to a at least one head drive mechanism for driving of said at least one polishing head in rotation and vertical motion with selected downward pressure of the polishing head;

at least one wafer alignment assembly attached to each of said at least one polishing head, wherein each of said at least one wafer alignment assembly comprises:

a wafer alignment assembly axis of rotation;

an upper plate;

a lower plate;

a wafer carrier removably attached to said lower plate;

three lever assemblies attached symmetrically about said wafer alignment assembly axis of rotation to said upper plate, wherein each of said three lever assemblies comprises a lever, a spherical joint and an elongated cylindrical hinge, and a kinematic axis for each of said three lever assemblies intersects a center of rotation of said spherical joint and a central long axis of said elongated cylindrical hinge, and said lower plate attaches to said upper plate by said three lever assemblies;

a gimbal point located in close proximity to an intersection between said kinematic axis of each of said three lever assemblies and said wafer alignment assembly axis of rotation, thereby enabling a wafer surface being polished to tilt in all directions relative to said gimbal point.

2. The wafer polishing apparatus of claim 1, wherein contact between said polishing pad and a wafer being polished establish a location of a wafer-pad interface, said lever assembly has a selected length, and a vertical position of said gimbal point relative to said wafer-pad interface is selectable by changing said selected length of said lever assembly.

3. The wafer polishing apparatus of claim 2, wherein a face of a wafer being polished has a diameter and the vertical position of said gimbal point relative to said wafer-pad interface is in a range from approximately −⅛ to ⅛ of the diameter, negative values refer to a location of said gimbal point below said wafer-pad interface, and positive values refer to a location of said gimbal point above said wafer-pad interface.

4. The wafer polishing apparatus of claim 1, further comprising at least one polishing head adapted to carry one wafer alignment assembly for polishing one wafer, wherein said polishing head further comprises a polishing head axis of rotation and said polishing head axis of rotation and said wafer alignment assembly axis of rotation are collinear.

5. The wafer polishing apparatus of claim 1, wherein said polishing head further comprises a polishing head mounting plate adapted for attachment of a wafer alignment assembly.

6. The wafer polishing apparatus of claim 1, wherein each of said at least one wafer alignment assembly further comprises a telescoping shaft and telescoping shaft housing for attachment of said upper plate to said polishing head.

7. The wafer polishing apparatus of claim 1, wherein said wafer polishing head is adapted to carry more than one wafer alignment assembly and each of said more than one wafer alignment assembly is separated by a same distance from a polishing head axis of rotation.

8. The wafer polishing apparatus of claim 7, further comprising a timing belt, wherein said telescoping shaft housings on a same polishing head are coupled together by said timing belt for synchronous rotation of wafers being polished on a same polishing head.

9. The wafer polishing apparatus of claim 7, further comprising a plurality of wafer alignment assemblies, wherein said telescoping shaft in each of said plurality of wafer alignment assemblies includes a plurality of spring washers for equalizing an amount of contact pressure between wafers attached to each of said plurality of said wafer alignment assemblies and said polishing pad.

10. The wafer polishing apparatus of claim 1, wherein each of said three lever assemblies provides an adjustable connection between said upper plate and said lower plate, and said adjustable connection changes a position of said gimbal point along said wafer alignment assembly axis of rotation.

11. The wafer polishing apparatus of claim 1, wherein said lever assembly further comprises:

an upper block adapted for attachment of said lever assembly to said upper plate;

a lower block adapted for attachment of said lever assembly to said lower plate;

a lever having a spherical joint at a first end and a cylindrical hinge at a second end; and a cylindrical pin for rotatably coupling said spherical joint of said lever to said upper block.

12. The wafer polishing apparatus of claim 1, wherein said wafer carrier and said lower plate comprise at least one hook plate and at least one horizontal rib for removable attachment of said wafer carrier to said lower plate by rotational motion of said wafer carrier.

13. The wafer polishing apparatus of claim 12, wherein said lower plate further comprises a spring-loaded latch adapted for gripping said hook plate.

14. A method comprising the steps of:

attaching a wafer to be polished to a wafer carrier;

attaching the wafer carrier to a wafer alignment assembly on a polishing head of a wafer polishing apparatus;

defining a location for a wafer-pad interface as a location of contact between a surface on the wafer being polished with a surface of a polishing pad;

selecting a vertical position of a gimbal point of the wafer alignment to be on the wafer alignment assembly axis of rotation , thereby enabling the wafer being polished to pivot about a point on a selected side of the wafer-pad interface;

optionally selecting a vertical position of a gimbal point to be coincident with the wafer-pad interface;

rotating a polishing pad in a first selected direction and at a first selected rate of rotation around a polishing pad axis of rotation;

rotating the polishing head in a second selected direction at a second selected rate of rotation around a polishing head axis of rotation, wherein said polishing head axis of rotation and said polishing pad axis of rotation are separated by a selected distance;

lowering the polishing head until the wafer to be polished contacts a working surface of the polishing pad, establishing thereby a wafer-pad interface;

adjusting an amount of contact pressure between the wafer being polished and the polishing pad;

polishing the wafer to achieve a selected quality of polishing;

disengaging the wafer from the turntable; and removing the wafer from the polishing head.

15. The method of claim 14, further comprising:

simultaneously polishing a batch of wafers, wherein a batch comprises a plurality of wafers coupled to a same polishing head; and rotating each of said plurality of wafers around a separate axis of rotation for each wafer.

16. The method of claim 15, further comprising the step of rotating all of said plurality of wafers in a same direction and at a same rate of rotation.

17. The method of claim 15, further comprising the step of placing the vertical position of a gimbal point below the wafer-pad interface, thereby causing more pressure to be applied to a trailing edge of the wafer being polished than to a leading edge of the wafer being polished.

18. The method of claim 15, further comprising the step of placing the vertical position of the gimbal point to be coincident with the wafer-pad interface, thereby causing uniform pressure to be applied to a surface on the wafer being polished.

19. The method of claim 15, further comprising the step of automatically adjusting an amount of contact pressure between each wafer being polished and the polishing pad so that the amount of contact pressure is approximately equal for all wafers being polished on the same polishing head.

20. A wafer polishing apparatus, comprising:

a rotatable polishing pad;

a rotatable polishing head; and a wafer alignment assembly attached to said polishing head, wherein said wafer alignment assembly comprises:

a wafer alignment assembly axis of rotation;

an upper plate able to move rotationally relative to said polishing pad;

a lower plate adapted for removable connection of a wafer carrier;

three lever assemblies for kinematically coupling said upper plate to said lower plate, wherein each of said three lever assemblies is attached to a bottom surface of said upper plate and to an upper surface of said lower plate, said three lever assemblies are spaced at equal-angle intervals around said wafer alignment assembly axis of rotation, and each of said three lever assemblies includes a spherical joint having a center of rotation, a cylindrical hinge having a central long axis, and a kinematic axis intersecting said spherical joint center of rotation, said cylindrical hinge central long axis, and said wafer alignment assembly axis of rotation;

a wafer carrier removably attachable to said lower plate; and a gimbal point located approximately at an intersection between said kinematic axis of each of said three lever assemblies and said wafer alignment assembly axis of rotation, thereby enabling a wafer surface being polished to tilt in all directions relative to said gimbal point.

21. The wafer polishing apparatus of claim 20, wherein a vertical position of said gimbal point is selected to be on said axis of rotation of said wafer alignment assembly and said vertical position of said gimbal point is further selected for optimizing quality of a polished wafer.

22. The wafer polishing apparatus of claim 21, wherein a vertical position of said gimbal point is selected to be in a range from approximately −1/8 to +1/8 of a diameter of a wafer being polished, wherein negative values refer to a gimbal point located below a contact area between said polishing pad and a surface of the wafer being polished and positive values refer to a gimbal point located above a contact area between said polishing pad and a surface of the wafer being polished.

23. The wafer polishing apparatus of claim 20, further comprising:

a plurality of said wafer alignment assemblies attached to said polishing head, wherein each of said plurality of wafer alignment assemblies further comprises a telescoping shaft for equalizing an amount of polishing pressure applied to each of a plurality of wafers being polished simultaneously.

24. The wafer polishing apparatus of claim 20, wherein each of said lever assemblies further comprises:

an upper lever block adapted for attachment to a bottom surface of said upper plate;

a lower lever block adapted for attachment to a top surface of said lower plate;

a lever having a first end and a second end, a spherical joint near said first end, and a diameter of said second end selected for a sliding fit into said lower lever block;

a cylindrical pin for rotatably coupling said spherical joint of said lever to said upper lever block;

a hinge block adapted for attachment to said lower plate; and a hinge pin for rotatably coupling said lower lever block to said hinge block.

25. The wafer polishing apparatus of claim 20, wherein said wafer alignment assembly further comprises:

a wafer carrier adapted to hold a wafer to be polished;

a plurality of hook plates attached to said wafer carrier;

a spring-loaded latch movably attached to said lower plate, wherein said spring-loaded latch is adapted for gripping at least one of said plurality of hook plates and removably securing the connection of said wafer carrier to said lower plate.

26. The wafer polishing apparatus of claim 20, further comprising a wafer-pad interface located at a contact area between a lower surface of a wafer being polished and an upper surface of said polishing pad, wherein said gimbal point is adjustable to a position coincident with said wafer-pad interface.

27. The wafer polishing apparatus of claim 20, further comprising a wafer-pad interface, wherein said gimbal point is adjustable to a position below said wafer-pad interface.

* * * * *